US007423003B2

(12) United States Patent
Volpenhein et al.

(10) Patent No.: US 7,423,003 B2
(45) Date of Patent: Sep. 9, 2008

(54) FOLD-RESISTANT CLEANING SHEET

(75) Inventors: Matthew Edward Volpenhein, Cincinnati, OH (US); Arman Ebrahimpour, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/929,733

(22) Filed: Aug. 14, 2001

(65) Prior Publication Data

US 2002/0062574 A1 May 30, 2002

Related U.S. Application Data

(60) Provisional application No. 60/237,835, filed on Oct. 3, 2000, provisional application No. 60/226,424, filed on Aug. 18, 2000.

(51) Int. Cl.
*C11D 17/04* (2006.01)
*D06L 1/20* (2006.01)

(52) U.S. Cl. ..... 510/438; 510/439; 510/281; 510/284; 510/291; 510/295; 510/297; 8/137

(58) Field of Classification Search ..... 510/438, 510/439, 281, 284, 291, 295, 297; 8/137
See application file for complete search history.

(56) References Cited

U.S. PATENT DOCUMENTS 2,257,428 A 9/1941 Ruegenberg
2,679,887 A 6/1954 Doyle et al.
2,862,251 A 12/1958 Kalwaites
2,896,692 A 7/1959 Villoresi
3,081,500 A 3/1963 Griswold et al.
3,081,512 A 3/1963 Griswold
3,283,357 A 11/1966 Decker et al.
3,354,022 A 11/1967 Dettre et al.
3,485,706 A 12/1969 Evans
3,542,634 A 11/1970 Such et al.
3,574,109 A 4/1971 Yoshikawa
3,597,299 A 8/1971 Thomas et al.
3,681,182 A 8/1972 Kalwaites
3,681,183 A 8/1972 Kalwaites
3,695,967 A 10/1972 Ross
3,695,985 A 10/1972 Brock et al.
3,728,203 A 4/1973 Taylor
3,800,364 A 4/1974 Kalwaites
3,855,046 A 12/1974 Hansen et al.
3,860,003 A 1/1975 Buell
3,881,987 A 5/1975 Benz
3,896,807 A 7/1975 Buchalter
3,910,284 A 10/1975 Orentreich
3,927,673 A 12/1975 Taylor
3,929,135 A 12/1975 Thompson (Continued)

FOREIGN PATENT DOCUMENTS

BE 855362 10/1977

(Continued)

*Primary Examiner*—Lorna M Douyon
(74) *Attorney, Agent, or Firm*—Mark A. Charles; Kim William Zerby; Steven W. Miller

(57) ABSTRACT

The present invention relates to cleaning sheets that resist folding, especially refolding upon themselves even after an initial fold has been formed in the sheet.

39 Claims, 11 Drawing Sheets

U.S. PATENT DOCUMENTS 3,949,127 A 4/1976 Ostermeier et al.
3,953,638 A 4/1976 Kemp
4,062,993 A 12/1977 Seward
4,076,633 A * 2/1978 Edwards et al. ..... 510/516
4,101,625 A 7/1978 Haley
4,116,892 A 9/1978 Schwarz
4,135,021 A 1/1979 Patchell et al.
4,153,664 A 5/1979 Sabee
4,189,395 A 2/1980 Bland
4,207,367 A 6/1980 Baker, Jr.
4,223,059 A 9/1980 Schwarz
4,276,336 A 6/1981 Sabee
4,285,100 A 8/1981 Schwarz
4,287,633 A 9/1981 Gropper
4,303,543 A 12/1981 Mansy
4,333,979 A 6/1982 Sciaraffa et al.
4,342,314 A 8/1982 Radel et al.
4,349,020 A 9/1982 Krikorian
4,355,066 A 10/1982 Newman
4,404,052 A 9/1983 Persson et al.
4,414,970 A 11/1983 Berry
4,418,123 A 11/1983 Bunnelle et al.
4,421,812 A 12/1983 Plant
4,515,703 A 5/1985 Haq
4,522,863 A 6/1985 Keck et al.
4,525,407 A 6/1985 Ness
4,559,157 A 12/1985 Smith et al.
4,569,343 A 2/1986 Kimura et al.
4,573,991 A 3/1986 Pieniak et al.
4,588,630 A 5/1986 Shimalla
4,600,620 A 7/1986 Lloyd et al.
4,603,069 A 7/1986 Haq et al.
4,606,964 A 8/1986 Wideman
4,609,518 A 9/1986 Curro et al.
4,629,643 A 12/1986 Curro et al.
4,657,802 A 4/1987 Morman
4,665,580 A 5/1987 Morris
4,674,237 A 6/1987 Sullivan
4,690,821 A 9/1987 Smith et al.
4,695,278 A 9/1987 Lawson
4,720,415 A 1/1988 Vander Wielen et al.
4,735,739 A 4/1988 Floyd et al.
4,741,944 A 5/1988 Jackson et al.
4,758,297 A 7/1988 Calligarich
4,758,467 A 7/1988 Lempiere et al.
4,769,022 A 9/1988 Chang et al.
4,797,310 A 1/1989 Barby et al.
4,801,482 A 1/1989 Goggans et al.
4,806,572 A 2/1989 Kellett
4,808,178 A 2/1989 Aziz et al.
4,816,025 A 3/1989 Foreman
4,820,435 A 4/1989 Zafiroglu
4,840,829 A 6/1989 Suzuki et al.
4,847,134 A 7/1989 Fahrenkrug et al.
4,891,227 A 1/1990 Thaman et al.
4,891,258 A 1/1990 Fahrenkrug
4,931,201 A 6/1990 Julemont
4,948,585 A 8/1990 Schlein
5,116,662 A 5/1992 Morman
5,139,841 A 8/1992 Makoui et al.
5,143,679 A 9/1992 Weber et al.
5,151,092 A 9/1992 Buell et al.
5,156,793 A 10/1992 Buell et al.
5,156,843 A 10/1992 Leong et al.
5,167,897 A 12/1992 Weber et al.
5,204,158 A 4/1993 Phillips et al.
5,208,089 A 5/1993 Norris
5,260,345 A 11/1993 DesMarais et al.
5,268,224 A 12/1993 DesMarais et al.
5,302,446 A 4/1994 Horn
5,320,891 A 6/1994 Levy et al.
5,338,766 A 8/1994 Phan et al.
5,376,198 A 12/1994 Fahrenkrug et al.
5,412,830 A 5/1995 Girardot et al.
5,413,811 A 5/1995 Fitting
5,431,991 A 7/1995 Quantrille et al.
5,451,219 A 9/1995 Suzuki et al.
5,507,968 A 4/1996 Palaikis
5,518,801 A 5/1996 Chappell et al.
5,536,555 A 7/1996 Zelazoski et al.
5,538,732 A 7/1996 Smith et al.
5,547,476 A * 8/1996 Siklosi et al. ..... 8/142
5,567,501 A 10/1996 Srinivasan et al.
5,587,225 A 12/1996 Griesbach et al.
5,591,236 A * 1/1997 Roetker ..... 8/137
5,595,567 A 1/1997 King et al.
5,605,749 A 2/1997 Pike et al.
5,620,779 A 4/1997 Levy et al.
5,623,888 A 4/1997 Zafiroglu
5,626,571 A 5/1997 Young et al.
5,628,097 A 5/1997 Benson et al.
5,630,847 A * 5/1997 Roetker ..... 8/137
5,630,848 A * 5/1997 Young et al. ..... 8/137
5,632,780 A * 5/1997 Siklosi ..... 8/137
5,635,290 A 6/1997 Stopper et al.
5,643,588 A 7/1997 Roe et al.
5,658,639 A 8/1997 Curro et al.
5,662,634 A 9/1997 Yamamoto et al.
5,681,302 A 10/1997 Melbye et al.
5,681,355 A * 10/1997 Davis et al. ..... 8/137
5,683,374 A 11/1997 Yamamoto et al.
5,683,794 A 11/1997 Wadsworth et al.
5,691,035 A 11/1997 Chappell et al.
5,698,475 A 12/1997 Vlasblom
5,700,387 A 12/1997 Haq et al.
5,702,992 A 12/1997 Martin et al.
5,714,107 A 2/1998 Levy et al.
5,733,822 A 3/1998 Gessner et al.
5,756,112 A 5/1998 Mackey
5,763,332 A 6/1998 Gordon et al.
5,789,368 A * 8/1998 You et al. ..... 510/297
5,804,021 A 9/1998 Abuto et al.
5,804,548 A * 9/1998 Davis ..... 510/439
5,830,555 A 11/1998 Srinivasan et al.
5,840,675 A 11/1998 Yeazell
5,846,232 A 12/1998 Serbiak et al.
5,851,935 A 12/1998 Srinivasan et al.
5,853,881 A 12/1998 Estey et al.
5,863,299 A * 1/1999 Holt et al. ..... 8/142
5,872,090 A * 2/1999 You et al. ..... 510/284
5,891,544 A 4/1999 Chappell et al.
5,906,879 A 5/1999 Huntoon et al.
5,916,661 A 6/1999 Benson et al.
5,919,411 A 7/1999 Rezai et al.
5,942,484 A * 8/1999 Roetker et al. ..... 510/426
5,965,504 A 10/1999 Reynolds
6,015,605 A 1/2000 Tsujiyama et al.
6,022,607 A 2/2000 James et al.
6,025,050 A 2/2000 Srinivasan et al.
6,027,593 A 2/2000 Lunt et al.
6,054,202 A 4/2000 Takeuchi et al.
6,057,024 A 5/2000 Mleziva et al.
6,086,984 A 7/2000 DiMaggio, Jr. et al.
6,106,925 A 8/2000 Palumbo
6,203,654 B1 3/2001 McFall et al.
6,262,009 B1 * 7/2001 Rogers et al. ..... 510/439

FOREIGN PATENT DOCUMENTS

CA 810361 4/1969
CN 1050066 3/1991
EP 0 112 654 A2 7/1984
EP 0211 664 2/1987
EP 0 127 483 B1 10/1989

| | | | |
|---|---|---|---|
| EP | 0 164 740 | B1 | 4/1990 |
| EP | 0186 208 | B1 | 5/1990 |
| EP | 0 161 911 | B1 | 8/1990 |
| EP | 0353 013 | B1 | 9/1993 |
| EP | 0 604 731 | | 7/1994 |
| EP | 0 421 163 | B1 | 11/1994 |
| EP | 0 432 755 | B1 | 5/1995 |
| EP | 0 432 763 | B1 | 8/1995 |
| EP | 0 685 586 | A2 | 12/1995 |
| EP | 0 687 757 | A2 | 12/1995 |
| EP | 0353 014 | B1 | 1/1996 |
| EP | 0 452 727 | B1 | 3/1996 |
| EP | 0750 062 | | 12/1996 |
| EP | 0 758 543 | A1 | 2/1997 |
| EP | 0 713 546 | B1 | 3/1997 |
| EP | 0 836 842 | | 5/1998 |
| EP | 0 864 418 | | 9/1998 |
| EP | 0 870 496 | | 10/1998 |
| EP | 0 677 284 | B1 | 6/1999 |
| EP | 0 919 212 | A2 | 6/1999 |
| EP | 0 945 251 | A1 | 9/1999 |
| EP | 0 945 536 | A2 | 9/1999 |
| EP | 0 955 159 | A1 | 11/1999 |
| EP | 0 823 878 | B1 | 8/2000 |
| JP | 06-017361 | | 1/1994 |
| JP | 08299385 | A | 11/1996 |
| WO | WO 94/19179 | A1 | 9/1994 |
| WO | WO 96/10979 | A1 | 4/1996 |
| WO | WO 97/11662 | A1 | 4/1997 |
| WO | WO 97/47264 | A1 | 12/1997 |
| WO | WO 98/27257 | | 6/1998 |
| WO | WO 98/44185 | * | 10/1998 |
| WO | WO 99/25288 | A1 | 5/1999 |
| WO | WO 99/37476 | A1 | 7/1999 |
| WO | WO 99/55273 | A1 | 11/1999 |
| WO | WO 99/55532 | A1 | 11/1999 |
| WO | WO 00/76430 | A1 | 12/2000 |
| WO | WO 01/45616 | A1 | 6/2001 |

* cited by examiner

FOLD-RESISTANT CLEANING SHEET

CROSS REFERENCE TO RELATED APPLICATIONS

This application claims priority under 37 U.S.C. § 119(e) to U.S. Provisional Application Ser. No. 60/226,424, filed Aug. 18, 2000 and to U.S. Provisional Application Ser. No. 60/237,835, filed Oct. 3, 2000.

FIELD OF THE INVENTION

The present invention relates to cleaning sheets that resist folding, especially refolding upon themselves even after an initial fold has been formed in the cleaning sheets, such as an initial fold formed for packaging reasons.

BACKGROUND OF THE INVENTION

Conventional cleaning sheets, especially those that are used in laundry dryers, have a strong tendency to refold upon themselves, especially during use.

When cleaning sheets refold upon themselves, they reduce the surface area and thus, the ability of the cleaning sheets to optimize the release of any cleaning ingredients contained on and/or in the cleaning sheet.

Accordingly, there is a need to develop cleaning sheets that resist folding, especially refolding upon themselves, even after an initial fold has been formed in the cleaning sheets.

SUMMARY OF THE INVENTION

The present invention fulfills the need by providing cleaning sheets, especially cleaning sheets used in dryers, that resist folding, especially refolding upon themselves.

It is known that materials have "memory" or lack thereof with respect to the desired physical state/shape of the materials. For example, with respect to conventional cleaning sheets they are oftentimes initially folded, at least one time and commonly more, in order to be packaged. Such fold lines created in conventional cleaning sheets create a memory in the cleaning sheets such that even after unfolding the cleaning sheets the cleaning sheets have a tendency to refold along the initial fold lines, especially when the cleaning sheet is tumbled, as in the case of use in an automatic clothes dryer.

It has surprising been found that the cleaning sheets of the present invention resist folding, especially refolding after an initial fold has been created in the sheet, such as an initial fold for packaging reasons. In other words, the cleaning sheets of the present invention do not retain the "memory" of being folded initially, unlike conventional cleaning sheets.

In one aspect of the present invention, a cleaning sheet comprising a material, preferably the chemical composition of which is such that the material resists folding is provided.

In another aspect of the present of invention, a cleaning sheet comprising one or more apertures that resists folding is provided.

In yet another aspect of the present invention, a cleaning sheet comprising an inner sheet and an outer sheet that wholly or partially encases the inner sheet such that the cleaning sheet resists folding is provided.

In still another aspect of the present invention, a cleaning sheet comprising at least two layers of material, wherein the layers are such that when an initial fold line is formed in the cleaning sheet the fold line in the two layers are aligned, and then upon use of the cleaning sheet the fold line in the two layers become nonaligned such that the cleaning sheet resists folding, is provided.

In still yet another aspect of the present invention, an overall non-immerion cleaning/refreshment process for treating a fabric, which optionally comprises a prespotting operation, comprising the overall steps of:

a) placing the fabric together with a cleaning sheet in accordance with the present invention in a tumbling apparatus; and b) operating the tumbling apparatus, is provided In still yet another aspect of the present invention, a kit comprising a plurality of cleaning sheets in accordance with the present invention is provided.

In even still yet another aspect of the present invention, a kit comprising:

a) one or more cleaning sheets in accordance with the present invention; and b) a re-usable containment bag, is provided.

In even still yet another aspect of the present invention, a kit comprising:

a) one or more cleaning sheets in accordance with the present invention; and b) a stain remover system, is provided.

In addition to resisting folding, the cleaning sheets of the present invention provide reduce and/or inhibit liquid transfer from the cleaning sheets to articles in contact with the cleaning sheets.

Accordingly, the present invention provides a cleaning sheet that resists folding, especially refolding upon itself, even after an initial fold has been formed in the cleaning sheet; processes for using such cleaning sheets, and kits comprising such cleaning sheets.

These and other objects, features and advantages of the present invention will be recognized by one of ordinary skill in the art from the following description and the appended claims.

All percentages, ratios and proportions herein are on a weight basis unless otherwise indicated. All documents cited herein are hereby incorporated by reference.

DETAILED DESCRIPTION

Definitions

Figure 1:
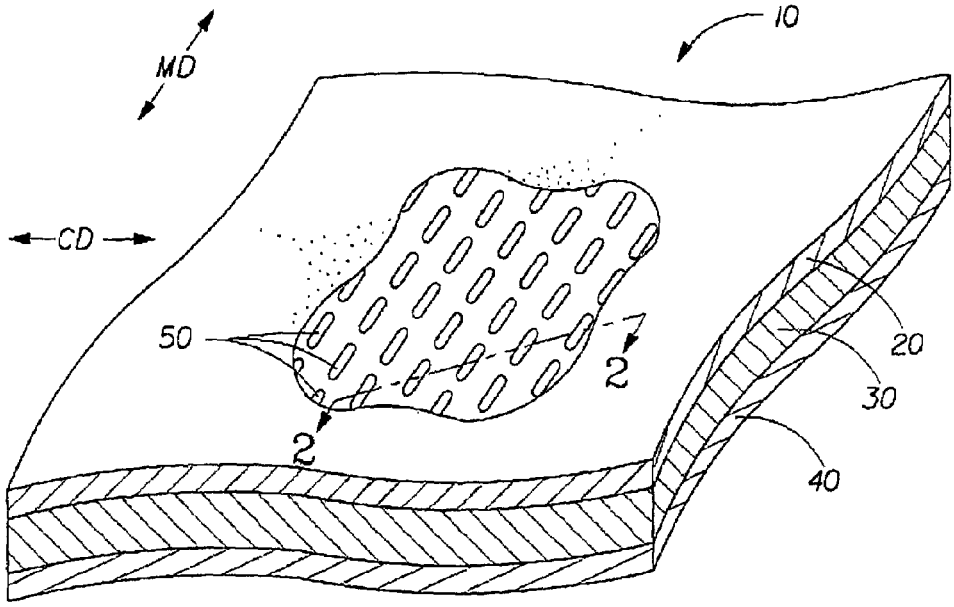
FIG. 1 is a perspective of one embodiment of a laminate web of the present invention.

"Resists folding"—"Resists folding" as used herein means that the cleaning sheet of the present invention has a tendency to remain in or return to an unfolded state if folding forces are exerted on the cleaning sheet, preferably as compared to conventional cleaning sheets.

As used herein, the term "absorbent article" refers to devices that absorb and contain fluids (e.g., water, cleansers, conditioners, polishes, body exudates). In certain instances, the phrase refers to devices that are placed against or in proximity to the body of the wearer to absorb and contain the various exudates discharged from the body. In other instances, the phrase refers to articles that have the ability to absorb and retain the benefit component until such time when the article is utilized by a consumer for its intended purpose.

The term "disposable" is used herein to describe articles of the present invention which are not intended to be laundered or otherwise restored or extensively reused (i.e., preferably, they are intended to be discarded after 25 uses, more preferably, after about 10 uses, even more preferably, after about 5 uses, and most preferably, after about a single use). It is preferred that such disposable articles be recycled, composted or otherwise disposed of in an environmentally compatible manner. A "unitary" disposable article refers to disposable articles that are formed of separate parts united together to form a coordinated entity so that they do not require separate manipulative parts like a separate holder and liner.

As used herein, the term "nonwoven web", refers to a web that has a structure of individual fibers or threads which are interlaid, but not in any regular, repeating manner. Nonwoven webs have been, in the past, formed by a variety of processes, such as, for example, meltblowing processes, spunbonding processes and bonded carded web processes.

As used herein, the term "microfibers" refers to small diameter fibers having an average diameter not greater than about 100 microns.

As used herein, the term "meltblown fibers" refers to fibers formed by extruding a molten thermoplastic material through a plurality of fine, usually circular, die capillaries as molten threads or filaments into a high velocity gas (e.g., air) stream which attenuates the filaments of molten thermoplastic material to reduce their diameter, which may be to a microfiber diameter. Thereafter, the meltblown fibers are carried by the high velocity gas stream and are deposited on a collecting surface to form a web of randomly dispersed meltblown fibers.

As used herein, the term "spunbonded fibers" refers to small diameter fibers that are formed by extruding a molten thermoplastic material as filaments from a plurality of fine, usually circular, capillaries of a spinneret with the diameter of the extruded filaments then being rapidly reduced by drawing.

As used herein, the term "polymer" generally includes, but is not limited to, homopolymers, copolymers, such as, for example, block, graft, random and alternating copolymers, terpolymers, etc., and blends and modifications thereof. Furthermore, unless otherwise specifically limited, the term "polymer" shall include all possible geometrical configurations of the material. These configurations include, but are not limited to, isotactic, syndiotactic and random symmetries.

As used herein, the term "elastic" refers to any material which, upon application of a biasing force, is stretchable, that is, elongatable, at least about 60 percent (i.e., to a stretched, biased length, which is at least about 160 percent of its relaxed unbiased length), and which, will recover at least 55 percent of its elongation upon release of the stretching, elongation force. A hypothetical example would be a one (1) inch sample of a material which is elongatable to at least 1.60 inches, and which, upon being elongated to 1.60 inches and released, will recover to a length of not more than 1.27 inches. Many elastic materials may be elongated by more than 60 percent (i.e., much more than 160 percent of their relaxed length), for example, elongated 100 percent or more, and many of these materials will recover to substantially their initial relaxed length, for example, to within 105 percent of their initial relaxed length, upon release of the stretch force.

As used herein, the term "nonelastic" refers to any material which does not fall within the definition of "elastic" above.

As used herein, the term "extensible" refers to any material which, upon application of a biasing force, is elongatable, at least about 50 percent without experiencing catastrophic failure.

The articles of the present invention comprise the following essential components.

Material Composition of the Cleaning Sheet

The cleaning sheets of the present invention are preferably made of a material, the chemical composition of which is such that the material resists folding. Preferably, the material comprises a polymer. More preferably, the material comprises a viscoelastic material.

Preferably the materials for use in the cleaning sheets of the present invention are nonwovens. Suitable nonwoven materials include, but are not limited to, cellulosics, sponges (i.e., both natural and synthetic), formed films, battings, and combinations thereof.

Nonlimiting examples of synthetic materials useful in the nonwoven materials include those selected from the group consisting of acetate fibers, acrylic fibers, cellulose ester fibers, modacrylic fibers, polyamide fibers, polyester fibers, polyolefin fibers, polyvinyl alcohol fibers, rayon fibers, polyethylene foam, polyurethane foam, and combinations thereof. Examples of suitable synthetic materials include acrylics such as acrilan, creslan, and the acrylonitrile-based fiber, orlon; cellulose ester fibers such as cellulose acetate, arnel, and acele; polyamides such as nylons (e.g., nylon 6, nylon 66, nylon 610, and the like); polyesters such as fortrel, kodel, and the polyethylene terephthalate fiber, polybutylene terephalate fiber, dacron; polyolefins such as polypropylene, polyethylene; polyvinyl acetate fibers; polyurethane foams and combinations thereof. These and other suitable fibers and the nonwovens prepared therefrom are generally described in Riedel, "Nonwoven Bonding Methods and Materials," *Nonwoven World* (1987); *The Encyclopedia Americana*, vol. 11, pp. 147-153, and vol. 26, pp. 566-581 (1984); U.S. Pat. No. 4,891,227, to Thaman et al., issued Jan. 2, 1990; and U.S. Pat. No. 4,891,228, each of which is incorporated by reference herein in its entirety.

Nonwovens made from natural materials consist of webs or sheets most commonly formed on a fine wire screen from a liquid suspension of the fibers. See C. A. Hampel et al., *The Encyclopedia of Chemistry*, third edition, 1973, pp. 793-795 (1973); *The Encyclopedia Americana*, vol. 21, pp. 376-383 (1984); and G. A. Smook, *Handbook of Pulp and Paper Technologies*, Technical Association for the Pulp and Paper Industry (1986); which are incorporated by reference herein in their entirety.

Natural material nonwovens useful in the cleaning sheets of the present invention may be obtained from a wide variety of commercial sources. Nonlimiting examples of suitable commercially available paper layers useful herein include Airtex®, an embossed airlaid cellulosic layer having a base weight of about 71 gsy, available from James River, Green Bay, Wis.; and Walkisoft®, an embossed airlaid cellulosic having a base weight of about 75 gsy, available from Walkisoft U.S.A., Mount Holly, N.C.

Additional suitable nonwoven materials include, but are not limited to, those disclosed in U.S. Pat. No. 4,447,294, issued to Osborn on May 8, 1984; U.S. Pat. No. 4,603,176 issued to Bjorkquist on Jul. 29, 1986; U.S. Pat. No. 4,981,557 issued to Bjorkquist on Jan. 1, 1991; U.S. Pat. No. 5,085,736 issued to Bjorkquist on Feb. 4, 1992; U.S. Pat. No. 5,138,002 issued to Bjorkquist on Aug. 8, 1992; U.S. Pat. No. 5,262,007 issued to Phan et al. on Nov. 16, 1993; U.S. Pat. No. 5,264,082, issued to Phan et al. on Nov. 23, 1993; U.S. Pat. No. 4,637,859 issued to Trokhan on Jan. 20, 1987; U.S. Pat. No. 4,529,480 issued to Trokhan on Jul. 16, 1985; U.S. Pat. No. 4,687,153 issued to McNeil on Aug. 18, 1987; U.S. Pat. No. 5,223,096 issued to Phan et al. on Jun. 29, 1993 and U.S. Pat. No. 5,679,222, issued to Rasch et al. on Oct. 21, 1997; U.S. Pat. No. 5,628,097 issued to Benson et al. on May 13, 1997; U.S. Pat. Nos. 5,916,661 and 5,658,639, both issued to Benson et al. on Jun. 29, 1999; each of which is incorporated by reference herein in its entirety.

Methods of making nonwovens are well known in the art. Generally, these nonwovens can be made by air-laying, water-laying, meltblowing, coforming, spunbonding, or carding processes in which the fibers or filaments are first cut to desired lengths from long strands, passed into a water or air stream, and then deposited onto a screen through which the fiber-laden air or water is passed. The resulting layer, regardless of its method of production or composition, is then subjected to at least one of several types of bonding operations to anchor the individual fibers together to form a self-sustaining web. In the present invention the layers that comprise nonwovens can be prepared by a variety of processes including, but not limited to, air-entanglement, hydroentanglement, thermal bonding, and combinations of these processes.

Nonlimiting examples of cleaning sheet materials are described in detail in U.S. Pat. No. 5,789,368, to You et al. which was incorporated herein by reference above. The manufacture of these sheets forms no part of this invention and is already disclosed in the literature. See, for example, U.S. Pat. No. 5,009,747, Viazmensky, et al., Apr. 23, 1991 and U.S. Pat. No. 5,292,581, Viazmensky, et al., Mar. 8, 1994, which are incorporated herein by reference.

Additional nonlimiting examples of cleaning sheet materials comprise a binderless (or optional low binder), hydroentangled absorbent material, especially a material which is formulated from a blend of cellulosic, rayon, polyester and optional bicomponent fibers. Such materials are available from Dexter, Non-Wovens Division, The Dexter Corporation as HYDRASPUN®, especially Grade 10244 and 10444. The manufacture of such materials forms no part of this invention and is already disclosed in the literature. See, for example, U.S. Pat. No. 5,009,747, Viazmensky, et al., Apr. 23, 1991 and U.S. Pat. No. 5,292,581, Viazmensky, et al., Mar. 8, 1994, incorporated herein by reference.

a. Viscoelastic Materials

Viscoelastic materials include, but are not limited to, non-Newtonian fluids/materials. Non-Newtonian fluids/materials are known to those of ordinary skill in the art.

Viscoelasticity is defined by the following equation, which is well known to those of ordinary skill in the art and is described in Introduction to Rheology; H. A. Barnes, J. F. Hutton, K. Walters; Elsevier Publishing; Copyright 1989; ISBN: 0444-871-40-3:

$$G^*=G'+i\,G''$$

where G* is complex shear modulus, G' is storage modulus, G" is loss modulus and i is the square root of −1. The storage modulus (G') is a measure of polymer elasticity while the loss modulus (G") is associated with the viscous energy dissipation (i.e., damping) by the polymer. The ratio of G" to G' is also a measure of damping (also called tan δ):

$$\tan\delta = \frac{G''}{G'}$$

which is a measure of ratio of the dissipated energy to the stored energy.

Modulus is measured by using the glass transition temperature of the material. If a material is at a temperature below, especially well below, its glass transition temperature, the material exhibits more solid properties than non-Newtonian liquid properties. If a material is at a temperature above, especially well above, its glass transition temperature, the material exhibits more non-Newtonian liquid properties than solid properties.

The materials for use in the cleaning sheets of the present invention preferably have a glass transition temperature which is below the use temperature of the cleaning sheets of the present invention and a melting point and/or decomposition temperature above the use temperature of the cleaning sheets. More preferably, the materials for use in the cleaning sheets of the present invention preferably have a glass transition temperature below about 15° C. and a melting point above about 200° C., even more preferably, the materials have a glass transition temperature below about 17° C. and a melting point above about 175° C., most preferably the materials have a glass transition temperature below about 20° C. and a melting point above about 150° C.

b. Differential Elongation Composite Cleaning Sheet

As shown in FIG. 1, in accordance with one embodiment of the present invention, the material (laminate web) 10 of the cleaning sheet of the present invention comprises at least three layers, webs or plies, disposed in a layered, face-to-face relationship, as shown in FIG. 1. The layers should be sufficiently thin to be processible as described herein, but no actual thickness (i.e., caliper) is considered limiting. A first outer layer and a second outer layer 20, 40 are known, respectively, as the first extensible web having a first elongation to break and as the second extensible web having a second elongation to break. The second outer layer preferably comprises the same material as the first outer layer but may be a different material. At least one third central layer 30 is disposed between the two outer layers. The laminate web 10 is processed by thermal calendaring as described below to provide a plurality of melt bond sites 50 that serve to bond the layers 20, 30 and 40, thereby forming the constituent layers into a unitary web. While the laminate web 10 is disclosed primarily in the context of nonwoven webs and composites, in principle the laminate web 10 can be made out of any web materials that meet the requirements, (e.g., melt properties, extensibility) as disclosed herein. For example, the constituent layers can be films, micro-porous films, apertured films, and the like.

Preferably, the first and second outer layers are nonwovens. Suitable nonwoven materials for the first and second outer layers include, but are not limited to, cellulosics, sponges (i.e., both natural and synthetic), formed films, battings, and combinations thereof. Preferably, the first and second outer layers each comprise materials selected from the group consisting of cellulosic nonwovens, formed films, battings, foams, sponges, reticulated foams, vacuum-formed laminates, scrims, and combinations thereof.

The first and second layers may comprise a variety of both natural and synthetic fibers or materials. As used herein, "natural" means that the materials are derived from plants, animals, insects or byproducts of plants, animals, and insects. The conventional base starting material is usually a fibrous web comprising any of the common synthetic or natural textile-length fibers, or combinations thereof.

Nonlimiting examples of natural materials useful in the layers of the laminate web include, but are not limited to, silk fibers, keratin fibers and cellulosic fibers. Nonlimiting examples of keratin fibers include those selected from the group consisting of wool fibers, camel hair fibers, and the like. Nonlimiting examples of cellulosic fibers include those selected from the group consisting of wood pulp fibers, cotton fibers, hemp fibers, jute fibers, flax fibers, and combinations thereof. Cellulosic fiber materials are preferred in the present invention.

Nonlimiting examples of synthetic materials useful in the layers of the laminate web include those selected from the group consisting of acetate fibers, acrylic fibers, cellulose ester fibers, modacrylic fibers, polyamide fibers, polyester fibers, polyolefin fibers, polyvinyl alcohol fibers, rayon fibers, polyethylene foam, polyurethane foam, and combinations thereof. Examples of suitable synthetic materials include acrylics such as acrilan, creslan, and the acrylonitrile-based fiber, orlon; cellulose ester fibers such as cellulose acetate, arnel, and acele; polyamides such as nylons (e.g., nylon 6, nylon 66, nylon 610, and the like); polyesters such as fortrel, kodel, and the polyethylene terephthalate fiber, polybutylene terephalate fiber, dacron; polyolefins such as polypropylene, polyethylene; polyvinyl acetate fibers; polyurethane foams and combinations thereof. These and other suitable fibers and the nonwovens prepared therefrom are generally described in Riedel, "Nonwoven Bonding Methods and Materials," *Nonwoven World* (1987); *The Encyclopedia Americana*, vol. 11, pp. 147-153, and vol. 26, pp. 566-581 (1984); U.S. Pat. No. 4,891,227, to Thaman et al., issued Jan. 2, 1990; and U.S. Pat. No. 4,891,228, each of which is incorporated by reference herein in its entirety.

Nonwovens made from natural materials consist of webs or sheets most commonly formed on a fine wire screen from a liquid suspension of the fibers. See C. A. Hampel et al., *The Encyclopedia of Chemistry*, third edition, 1973, pp. 793-795 (1973); *The Encyclopedia Americana*, vol. 21, pp. 376-383 (1984); and G. A. Smook, *Handbook of Pulp and Paper Technologies*, Technical Association for the Pulp and Paper Industry (1986); which are incorporated by reference herein in their entirety.

Natural material nonwovens useful in the laminate web of present invention may be obtained from a wide variety of commercial sources. Nonlimiting examples of suitable commercially available paper layers useful herein include Airtex®, an embossed airlaid cellulosic layer having a base weight of about 71 gsy, available from James River, Green Bay, Wis.; and Walkisoft®, an embossed airlaid cellulosic having a base weight of about 75 gsy, available from Walkisoft U.S.A., Mount Holly, N.C.

Additional suitable nonwoven materials include, but are not limited to, those disclosed in U.S. Pat. No. 4,447,294, issued to Osborn on May 8, 1984; U.S. Pat. No. 4,603,176 issued to Bjorkquist on Jul. 29, 1986; U.S. Pat. No. 4,981,557 issued to Bjorkquist on Jan. 1, 1991; U.S. Pat. No. 5,085,736 issued to Bjorkquist on Feb. 4, 1992; U.S. Pat. No. 5,138,002 issued to Bjorkquist on Aug. 8, 1992; U.S. Pat. No. 5,262,007 issued to Phan et al. on Nov. 16, 1993; U.S. Pat. No. 5,264,082, issued to Phan et al. on Nov. 23, 1993; U.S. Pat. No. 4,637,859 issued to Trokhan on Jan. 20, 1987; U.S. Pat. No. 4,529,480 issued to Trokhan on Jul. 16, 1985; U.S. Pat. No. 4,687,153 issued to McNeil on Aug. 18, 1987; U.S. Pat. No. 5,223,096 issued to Phan et al. on Jun. 29, 1993 and U.S. Pat. No. 5,679,222, issued to Rasch et al. on Oct. 21, 1997; U.S. Pat. No. 5,628,097 issued to Benson et al. on May 13, 1997; U.S. Pat. Nos. 5,916,661 and 5,658,639, both issued to Benson et al. on Jun. 29, 1999; each of which is incorporated by reference herein in its entirety.

Methods of making nonwovens are well known in the art. Generally, these nonwovens can be made by air-laying, water-laying, meltblowing, coforming, spunbonding, or carding processes in which the fibers or filaments are first cut to desired lengths from long strands, passed into a water or air stream, and then deposited onto a screen through which the fiber-laden air or water is passed. The resulting layer, regardless of its method of production or composition, is then subjected to at least one of several types of bonding operations to anchor the individual fibers together to form a self-sustaining web. In the present invention the layers that comprise nonwovens can be prepared by a variety of processes including, but not limited to, air-entanglement, hydroentanglement, thermal bonding, and combinations of these processes.

The less extensible third central layer may also be a nonwoven as described above. Yet, the central layer 30 itself need not be thermally compatible with the outer layers. The central layer 30 need not even be melt processible. It can be, for example, a cellulosic material, such as paper, tissue, paper towel, paper napkins; a metallic material, such as a metallic foil; a woven or knit material, such as cotton or rayon blends; or a thermoset material, such as a polyester or aromatic polyamide film. The central layer 30 can be another nonwoven having suitable properties for processing into an apertured layer. If central layer 30 has a melting point, it is preferably at least about 20° C. higher than the outer layers. The central layer 30, however, need not have a melting point, and may simply experience softening at the calendaring temperatures required to bond the laminate. In certain central layer materials, such as metallic foils, there is not even any softening due to thermal processing of the web.

One of the unexpected advantages of the present invention is the discovery that novel web properties can be exhibited by the choice of central layer 30 disposed between the two outer layers. Preferably, the central layer material is selected from the group consisting of cellulosics, thermoplastic battings, metallic foils, metallic battings, sponges, formed films, and combinations thereof. Suitable materials for the central layer may include those discussed above. It is important, however, that the central layer have a third elongation break that is less than both the first and second outer layers. The wide range of possible central layer materials permits a surprising variety of structures of the present invention, each having beneficial application in a wide assortment of end uses. For example, when outer layers of nonwoven material are used with a central layer of metallic foil, the resulting laminate is a flexible, soft, formable, metallic web that is relatively silent when folded, crumpled or otherwise deformed. Such a material can be used in applications requiring electrical shielding, for example. When a central layer of tissue paper is used, the resulting laminate is a soft, bulky, absorbent web. Such a laminate is suitable for use as a wiping implement, for example. Further, since the laminate web 10 is formed without the use of thermoplastic adhesives, durable, garment-like properties can be obtained. Such laminates can be laundered a number of times before suffering unacceptable wear.

Figure 2:
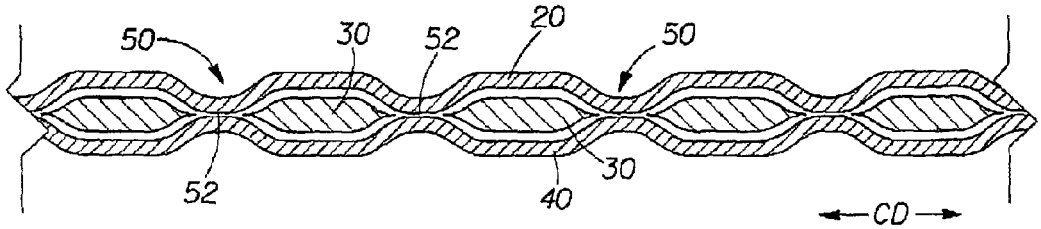
FIG. 2 is a cross-sectional view of a portion of the laminate web shown in FIG. 1.

As shown in FIG. 2, central layer 30 is chosen such that when the constituent web layers of laminate web 10 are processed as detailed below, portions of central layer 30 in the region of the melt bond sites 50 separate to permit the first layer 20 to melt bond directly to the second outer layer 40 at the interface of the two materials 52 at melt bond sites 50. Without being bound by theory, it is believed that the process of the present invention facilitates such separation of central layer 30 by shearing, cutting, or otherwise fracturing the central layer, and displacing the material of the central layer sufficiently to permit thermal bonding of the two outer layers. Thus, central layer 30 should be chosen to have properties that permit such cutting through, such as relatively low extensibility, relatively high frangibility, or relatively high deformability, such that the material of central layer 30 can be "squeezed" out of the region of thermal bond sites 50.

Figure 3:
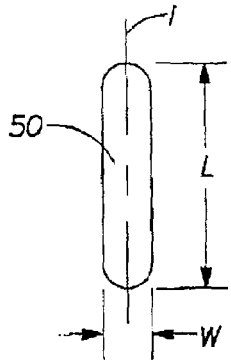
FIG. 3 is a magnified detail view of one bond site of a laminate web of the present invention.

Without being bound by theory, it is believed that to accomplish the bonding of the layers of the laminate web to form apertures therein, the thermal point calendaring described below should form thermal bond sites having a narrow width W dimension and a high aspect ratio. For example, FIG. 3 shows the melt area of a single melt bond site 50 having a narrow width dimension W and a high aspect ratio, i.e., the length, L, is much greater than the width, W. The length L should be selected to permit adequate bond area while width W is sufficiently narrow such that the protuberance used to form the bond site (as described below) can cut, shear, or otherwise pierce the layers 20, 30, 40 at the region of the bond sites by the method described below. Width W can be between about 0.003 inches and 0.020 inches, but in a preferred embodiment, is between about 0.005 inches and 0.010 inches, and may be adjusted depending on the properties of central layer 30.

It is believed that the aspect ratio can be as low as about 3 (i.e., ratio of L/W equals 3/1). It can also be between about 4 and 20. In one preferred embodiment, the aspect ratio was about 10. The aspect ratio of the melt bond sites 50 is limited only by the corresponding aspect ratio of the point bonding protuberances of the calendaring roller(s), as detailed below.

In a preferred embodiment, the longitudinal axis of each bond site, 1, which corresponds directionally to the length dimension of bond site 50, is disposed in a regular, repeating pattern oriented generally in the machine direction, MD as shown in FIG. 1. But the bond sites may be disposed in a regular, repeating pattern oriented in the cross machine direction, or randomly oriented in a mixture of cross and machine directions. For example, the bond sites 50 can be disposed in a "herringbone" pattern.

Another benefit of the present invention is obtained when the thermally bonded laminate web described above is stretched or extended in a direction generally orthogonal to the longitudinal axis, 1, of melt bond sites 50. The melt bonding at the melt bond sites 50 tends to make localized weakened portions of the web at the bond sites. Thus, as portions of the web 10 are extended in a direction generally orthogonal to the longitudinal axis 1 of bond sites 50, the material at the bond site fails in tension and an aperture is formed. The relatively high aspect ratio of melt bond sites 50, permits a relatively large aperture to be formed upon sufficient extension. When the laminate web 10 is uniformly tensioned, the result is a regular pattern of a plurality of apertures 60 corresponding to the pattern of melt bond sites 50.

Figure 4:
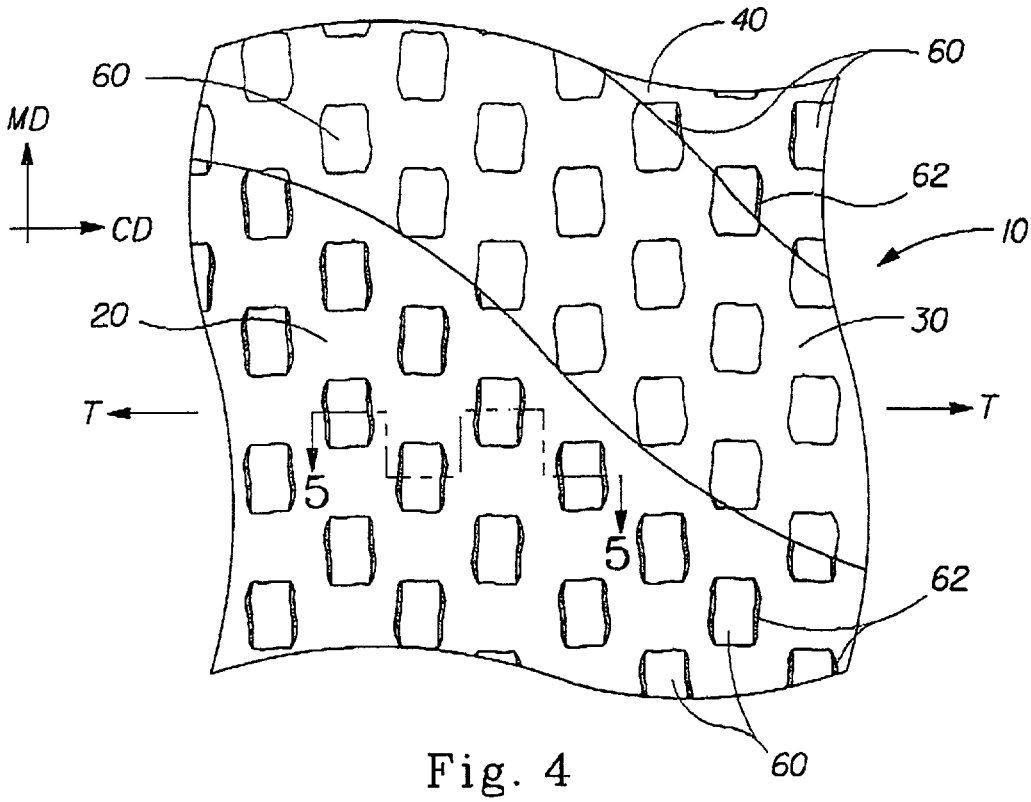
FIG. 4 is a top plan view of another embodiment of the laminate web of the present invention.

FIG. 4 shows a partially cut-away representation of an apertured laminate web useful for the present invention. As shown, the partial cut-away permits each layer or ply to be viewed in a plan view. The laminate web 10 shown in FIG. 4 is produced after the thermally bonded laminate is stretched in a direction orthogonal to the longitudinal axis of the melt bond sites, in this case, in the cross-machine direction, CD. As shown, where formerly were melt bond sites 50, apertures 60 are produced as the relatively weak bond sites fail in tension. Also as shown, central layer 30 can remain generally uniformly distributed within laminate 10, depending on the material properties of central layer 30.

When apertures 60 are formed, the thermally bonded portions of layers 20, 30, 40 remain primarily on the portions of the aperture perimeters corresponding to the length dimension of bond sites 50. Therefore, each aperture 60 does not have a perimeter of thermally bonded material, but only portions remain bonded, represented as 62 in FIG. 4. One beneficial property of such a laminate web is that once apertured, fluid communication with the central layer is facilitated. Thus, an absorbent central layer 30 can be used between two relatively non-absorbent outer layers, and the laminate 10 could be an absorptive wiper with a relatively dry to the touch outer surface.

Figure 5:
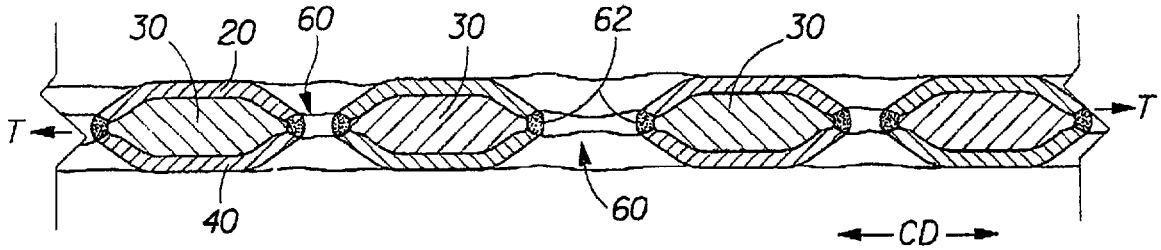
FIG. 5 is a cross-sectional view of a portion of the laminate web shown in FIG. 4.

FIG. 5 is a schematic representation of the cross-section denoted in FIG. 4. As shown, apertures 60 form when the laminate web is elongated in the direction T.

In certain preferred embodiments, the laminate web is characterized by having from about 10% to about 20% of the surface area be "open area." As used herein, "open area" means that the web is apertured or hole-containing such that the amount of material necessary to cover a certain area is minimized due expansion of the web that takes place after stretching/ring rolling. More preferably, the open area of the web is from about 11% to about 17%.

Another benefit of the articles of the present invention that is derived when the laminate web is extended as described with reference to FIG. 4, is that the central layer 30 that has an elongation to break less than either of the two outer layers fails in tension at a lower extensibility than does either of the outer layers. Thus, when the laminate is extended generally orthogonal to the longitudinal axis, 1, of melt bond sites 50, outer layers 20 and 40 extend to form apertures. However, central layer 30, which has an elongation to break less than that of the outer layers, fractures upon sufficient extension, such that after extension central layer 30 is no longer uniformly distributed over the non-apertured regions of the laminate web 10.

An example of one embodiment of a web having a central layer having an elongation to break less than either of the two outer layers is shown partially cut-away in FIG. 5. The partial cut-away permits each layer or ply to be viewed in a plan view. As shown, after extension, central layer 30 becomes fragmented, forming discontinuous regions of the central layer material. These discontinuous regions may be relatively uniformly distributed, such as in rows as shown in FIG. 5, or may be relatively randomly distributed, depending on the pattern of melt bond sites 50 and the method of extension employed. One example of a web 10 having a structure similar to that shown in FIG. 5 is a web having outer layers of relatively extensible nonwovens, with a central layer of relatively low extensibility tissue paper.

Figure 6:
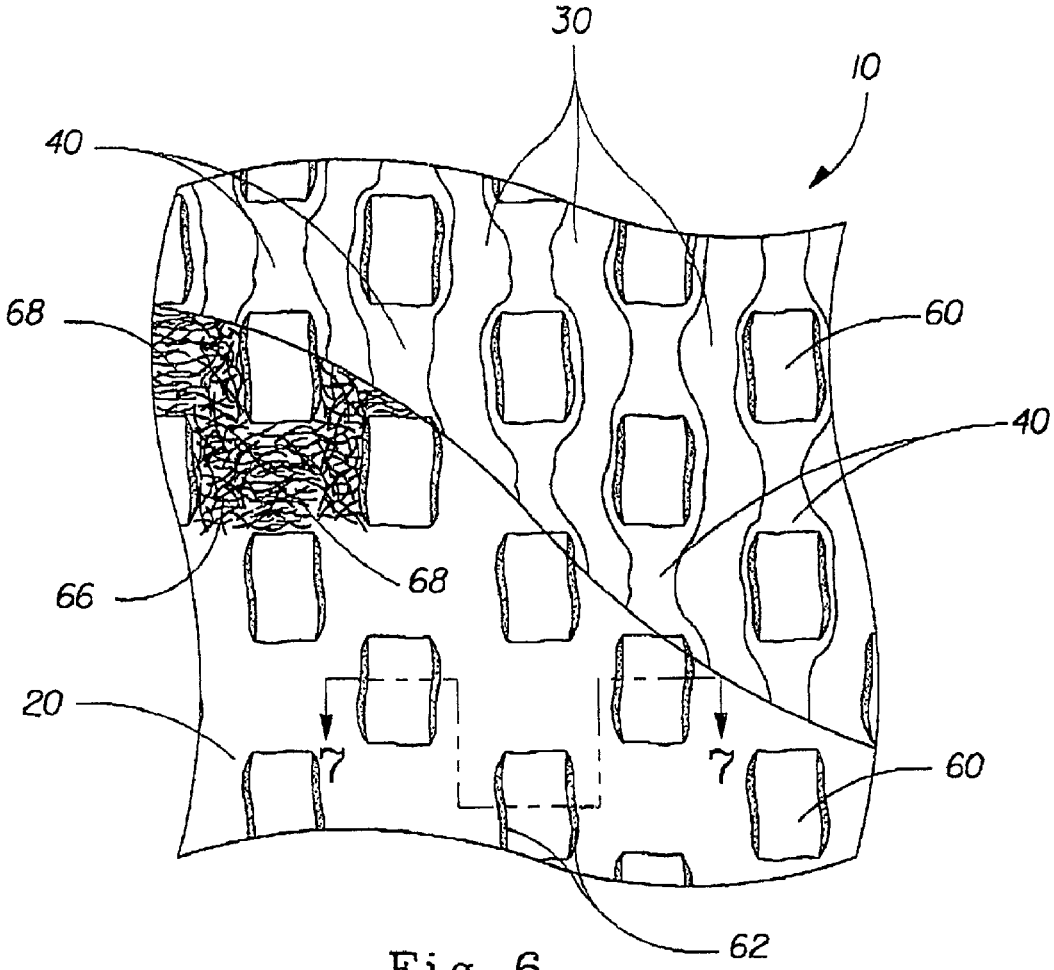
FIG. 6 is a top plan view of another embodiment of the laminate web of the present invention.

A surprising benefit of the laminate web structure described in FIG. 6 is the presence of distinct regions in the non-apertured portion of the web being differentiated by at least one property selected from the group consisting of basis weight, thickness, density, and combinations thereof. As shown in the cross-section of FIG. 7, several such regions can be differentiated. In a preferred embodiment, the regions are visually distinct, giving the laminate web an aesthetically pleasing look and feel that is particularly useful in the articles of the present invention. The regions may also give the laminate a garment-like or knit-like texture.

Figure 7:
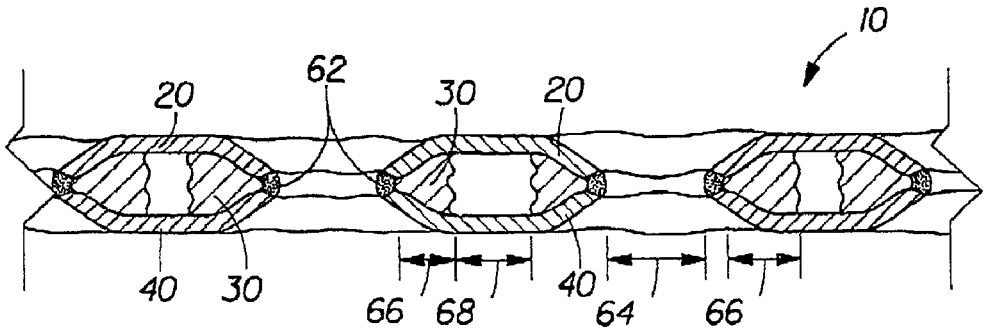
FIG. 7 is a cross-sectional view of a portion of the laminate web shown in FIG. 6.

With reference to FIG. 7, several structurally distinct regions can be identified in the cross-section shown. The region denoted 64 corresponds to the aperture 60. In the non-apertured area of the web, a region 66 is a relatively high basis weight region comprising central layer 30. Region 68 represents the portion of the laminate web in which central layer 30 has fractured and separated, i.e., is no longer fully present, forming a relatively low basis weight region of web 10. In general, the higher basis weight regions will also be correspondingly higher density regions, but need not be so. For example, a post-extension embossing process can be applied to web 10 to form regions of multiple densities in addition to the regions of multiple basis weight. For either the high basis weight regions or the high density regions, often the differences can be discernible by simply rubbing between the fingers.

In general, for a laminate web 10 having generally parallel rows of melt bond sites 50 extending in the machine direction MD, which correspondingly form generally parallel rows of apertures when extended, and having a central layer with a lower elongation to break than the outer layers, the resulting extended, apertured laminate web 10 is characterized by generally low basis weight, low density regions between the apertures in the machine direction, MD, e.g., region 68 in FIGS. 6 and 7. Likewise, the laminate web 10 is characterized by relatively high basis weight, high density regions between adjacent rows of apertures in the cross-machine direction, CD, e.g., region 66 in FIG. 7. By choice of central layer material 30 and possibly post laminating operations, e.g., an embossing process, the thickness of the laminate web can likewise be varied, the thicker regions generally corresponding to the higher density regions.

Another embodiment of a laminate web useful for the present invention utilizes nonwoven webs as the outer layers is characterized by distinct regions differentiated by fiber orientation. Differential fiber orientation can be achieved by providing for localized regions within the web that experience greater extension than other regions. For example, by locally straining the web 10 to a greater degree in the regions corresponding to regions 68 in FIG. 6, regions of significant fiber reorientation are formed. Such localized straining is possible by the method of the present invention detailed below.

Figure 8:
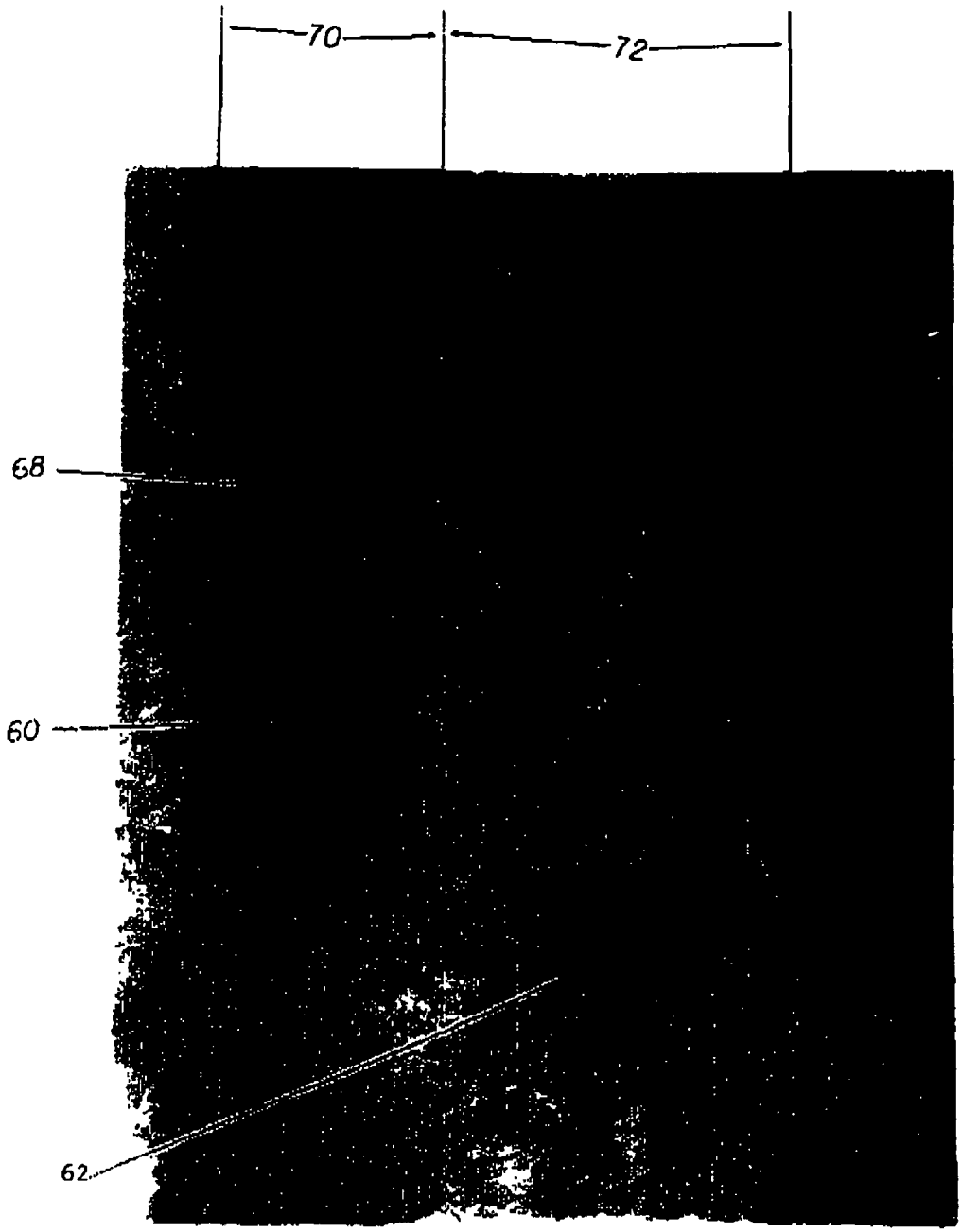
FIG. 8 is a photomicrograph of one embodiment of a laminate web of the present invention.

FIG. 8 is a photomicrograph showing in magnified detail a web of the present invention which has been extended to form apertures, and locally extended to produce regions 68 of fiber reorientation. As can be seen in FIG. 8, by locally extending portions of the web to a greater extent than others, the apertures formed thereby can be of different sizes. Thus, the region denoted generally as 70 in FIG. 8 has undergone more strain (i.e., local extension) than the region denoted by 72. Thus, the apertures in region 70 are larger than those in region 72, and the basis weight of the nonwoven web material in region 72 is less than the basis weight of the nonwoven web in region 70. In addition to the difference in basis weight due to localized strain differentials, the laminate web of the present invention can also exhibit distinct regions 68 of fiber reorientation. In these regions, the fibers have been reoriented from a generally random orientation to a predominant orientation in the direction of extension.

To make a web 10 as shown in FIG. 6, central layer 30 can be any of a great number of dissimilar materials. For example, if outer layers 20 and 40 are nonwoven webs having a relatively high elongation to break, central layer 30 can be paper, tissue paper, thermoplastic film, metal foil, closed or open cell foam, or any other material that has a relatively low elongation to break compared to the two outer layers. The outer layer materials may themselves be dissimilar, with the only constraint being that the central layer be relatively less extensible in the direction of extension to form apertures.

Additionally, more than one central layer 30 can be used with beneficial results. For example, a laminate web comprising a cellulosic tissue central layer and an additional central layer comprising a polymeric film wherein both central layers are disposed between nonwoven first and second outer layers can produce an absorptive wiping article with one side being relatively more absorptive than the other. If the additional polymeric film central layer is a three-dimensional formed film, the film side can provide added texture to the laminate that is beneficial in many wiping applications. Macroscopically-expanded, three-dimensional formed films suitable for use in the present invention include those described in commonly-assigned U.S. Pat. No. 3,929,135 issued to Thompson on Dec. 30, 1975, and U.S. Pat. No. 4,342,314 issued to Radel et al. on Aug. 3, 1982, both patents hereby incorporated herein by reference.

The (or "a") central layer can also be elastomeric, and can be an elastomeric macroscopically-expanded, vacuum-formed, three-dimensional formed film, such as described in commonly-assigned U.S. Ser. No. 08/816,106, now abandoned entitled "Tear Resistant Porous Extensible Web" filed by Curro et al. on Mar. 14, 1997, and hereby incorporated herein by reference. Further, the (or "a") central layer can be a three-dimensional formed film having micro-apertures such as described in commonly-assigned U.S. Pat. No. 4,629,643 issued to Curro et al. on Dec. 16, 1986, and U.S. Pat. No. 4,609,518, issued to Curro et al. on Sep. 2, 1986, both of which are hereby incorporated herein by reference.

The (or "a") central layer can be a web material having a strainable network as disclosed in U.S. Pat. No. 5,518,801 issued to Chappell et al. on May 21, 1996, and hereby incorporated herein by reference. Such a web can be a structural elastic-like film (SELF) web, formed by, for example, embossing by mating plates or rolls.

The (or "a") central layer can be an absorbent open cell foam web material. Particularly suitable absorbent foams for high performance absorbent articles such as diapers have been made from High Internal Phase Emulsions (hereafter referred to as "HIPE"). See, for example, U.S. Pat. No. 5,260,345 (DesMarais et al), issued Nov. 9, 1993 and U.S. Pat. No. 5,268,224 (DesMarais et al), issued Dec. 7, 1993, hereby incorporated herein by reference. These absorbent HIPE foams provide desirable fluid handling properties, including: (a) relatively good wicking and fluid distribution characteristics to transport the imbibed urine or other body fluid away from the initial impingement zone and into other regions of the foam structure to allow for subsequent gushes of fluid to be accommodated; and (b) a relatively high storage capacity with a relatively high fluid capacity under load, i.e. under compressive forces.

The central layer 30 may further comprise absorbent gelling materials. For example, supersorbers or hydrogel materials may provide for superior absorbency when the laminate web of the present invention is used as an absorbent wipe or a core in a disposable absorbent article of the present invention. By "hydrogel" as used herein is meant an inorganic or organic compound capable of absorbing aqueous fluids and retaining them under moderate pressures. For good results the hydrogels should be water insoluble. Examples are inorganic materials such as silica gels and organic compounds such as cross-linked polymers. Cross-linking may be by covalent, ionic, van der Waals, or hydrogen bonding. Examples of polymers include polyacrylamides, polyvinyl alcohol, ethylene maleic anhydride copolymers, polyvinyl ethers, hydroxypropyl cellulose, carboxymethyl cellulose, polyvinyl pyridine and the like. Suitable gelling materials are described below in the "optional ingredients" that relates to the personal care articles of the present invention. It should be understood, however, that such gelling materials may also be utilized in each of the articles of the present invention, irrespective of the intended use of the article.

The structure of the laminate web is particularly useful in the assembly of the articles of the present invention since the web can be made of dissimilar materials without the use of adhesive for joining. The plurality of melt bond sites 50 are sufficient to keep the component webs together in the laminate web, so that the laminate web behaves as a unitary web for processing integrity and use, without unwanted delamination. However, in some embodiments, and for certain materials, it may be beneficial to apply adhesive between at least two of the constituent layers.

Method of Making the Laminate Web

Figure 9:
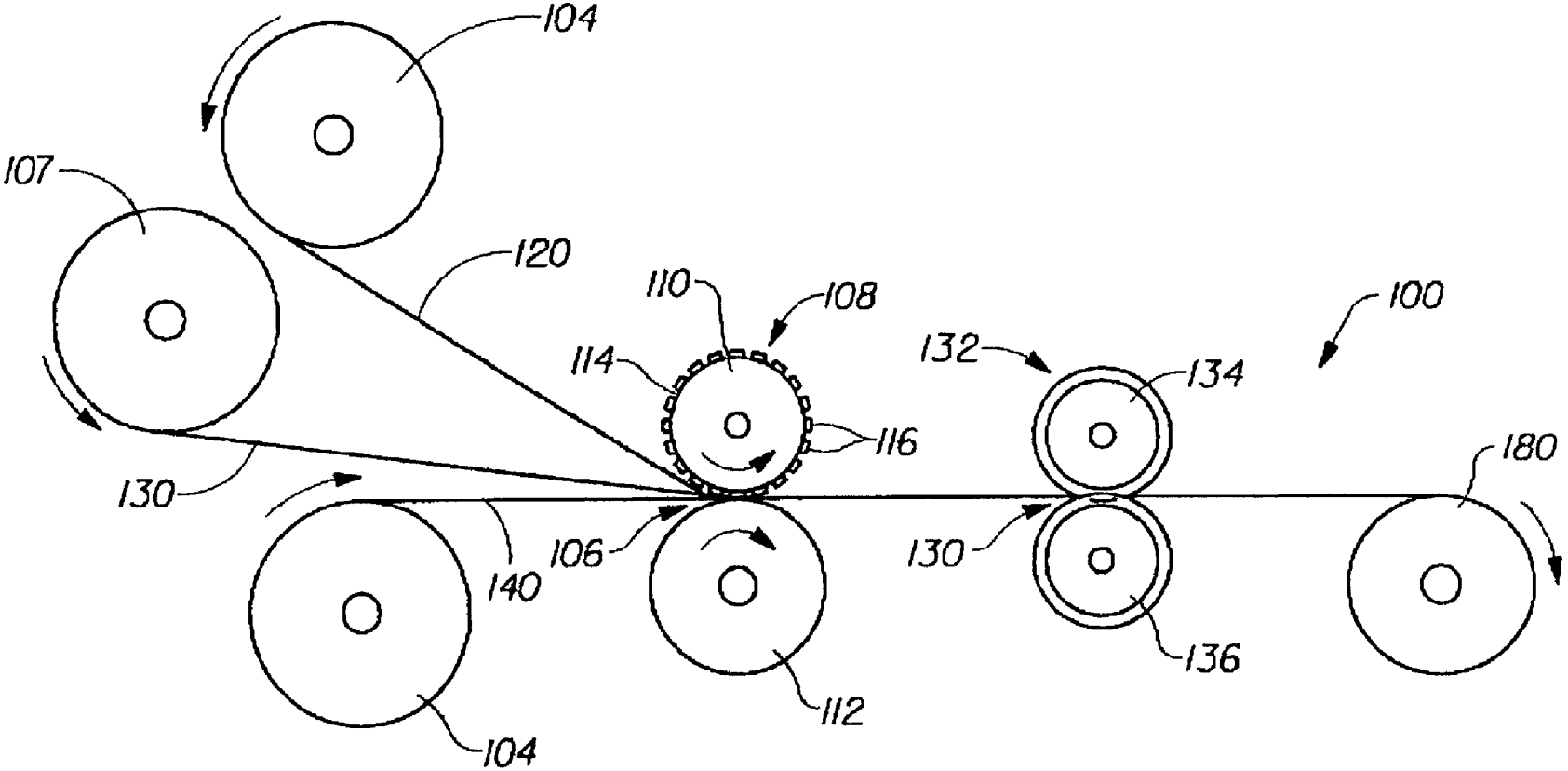
FIG. 9 is a schematic representation of a process for making a laminate web of the present invention.

Referring to FIG. 9 there is schematically illustrated at 100 a process for making a laminate web of the present articles.

A first relatively extensible web 120 is unwound from a supply roll 104 and travels in a direction indicated by the arrows associated therewith as the supply roll 104 rotates in the direction indicated by the arrows associated therewith. Likewise a second relatively extensible web 140 is unwound from supply roll 105. A central layer 130 is likewise drawn from supply roll 107. The three components (or more, if more than one central layer is used) pass through a nip 106 of the thermal point bond roller arrangement 108 formed by rollers 110 and 112.

Either outer layer can comprise a formed film, such as a three-dimensional formed film having micro-apertures such as described in commonly-assigned U.S. Pat. No. 4,629,643 issued to Curro et al. on Dec. 16, 1986, and U.S. Pat. No. 4,609,518, issued to Curro et al. on Sep. 2, 1986, both of which are hereby incorporated herein by reference.

In a preferred embodiment, both outer layers comprise nonwoven materials, and may be the identical. The nonwoven material may be formed by known nonwoven extrusion processes, such as, for example, known meltblowing processes or known spunbonding processes, and passed directly through the nip 106 without first being bonded and/or stored on a supply roll. However, in a preferred embodiment, the nonwoven webs are themselves thermally point bonded (consolidated) webs commercially available on supply rolls.

The nonwoven web outer layer(s) may be elastic or nonelastic so long as the third central layer is less extensible than both the first and second outer layers. The nonwoven web may be any melt-fusible web, including a spunbonded web, a meltblown web, or a bonded carded web. If the nonwoven web is a web of meltblown fibers, it may include meltblown microfibers. The nonwoven web may be made of fiber forming polymers such as, for example, polyolefins. Exemplary polyolefins include one or more of polypropylene, polyethylene, ethylene copolymers, propylene copolymers, and butene copolymers. The nonwoven web can have a basis weight between about 10 to about 60 grams per square meter (gsm), and more preferably about 15 to about 30 gsm.

The nonwoven outer layers may themselves each be a multilayer material having, for example, at least one layer of a spunbonded web joined to at least one layer of a meltblown web, a bonded carded web, or other suitable material. For example, the nonwoven web may be a multilayer web having a first layer of spunbonded polypropylene having a basis weight from about 0.2 to about 8 ounces per square yard, a layer of meltblown polypropylene having a basis weight from about 0.2 to about 4 ounces per square yard, and a second layer of spunbonded polypropylene having a basis weight from about 0.2 to about 8 ounces per square yard. Alternatively, the nonwoven web may be a single layer of material, such as, for example, a spunbonded web having a basis weight from about 0.2 to about 10 ounces per square yard or a meltblown web having a basis weight from about 0.2 to about 8 ounces per square yard.

The nonwoven web outer layers may also be a composite made up of a mixture of two or more different fibers or a mixture of fibers and particles. Such mixtures may be formed by adding fibers and/or particulates to the gas stream in which the meltblown fibers or spunbond fibers are carried so that an intimate entangled co-mingling of fibers and other materials, e.g., wood pulp, staple fibers and particles occurs prior to collection of the fibers.

Prior to processing the laminate web as described herein, the outer cover of the fibers of the respective layers can be joined by bonding to form a coherent web structure. Suitable bonding techniques include, but are not limited to, chemical bonding, ultrasonic bonding, thermobonding, such as point calendering, hydroentangling, and needling.

Figure 10:
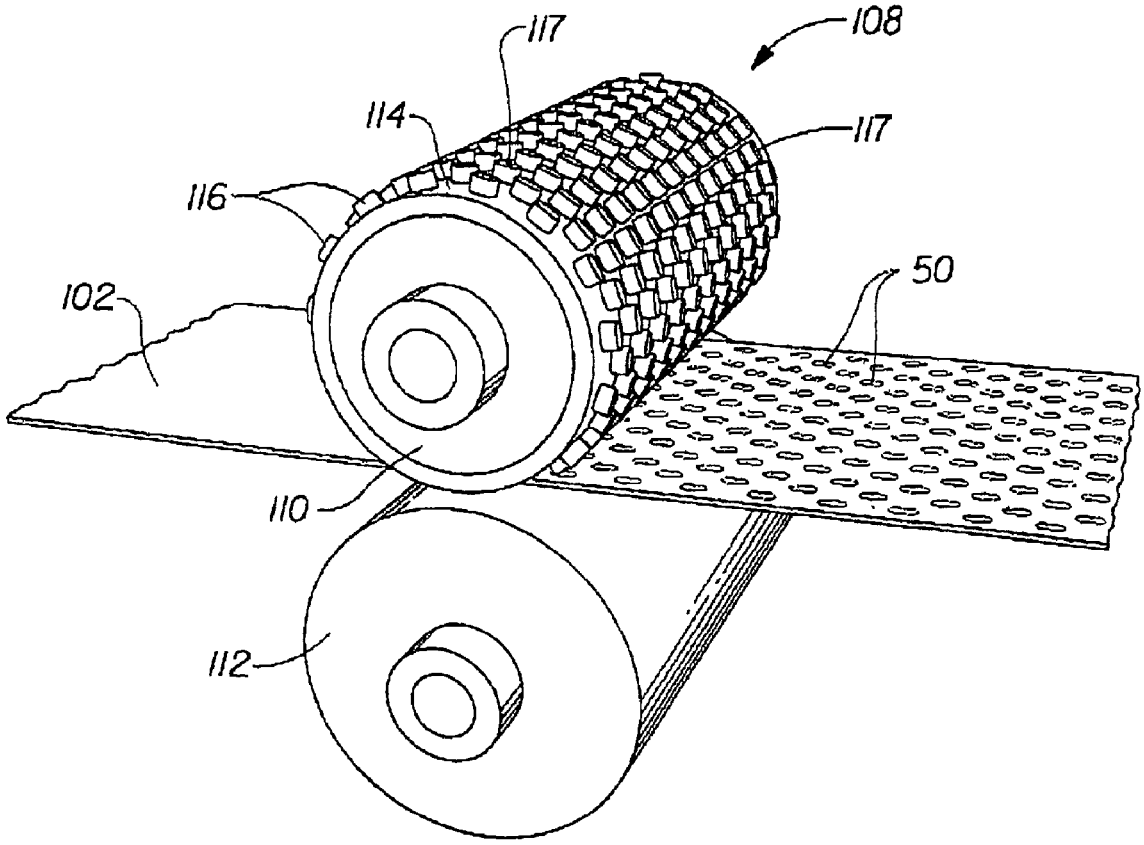
FIG. 10 is a perspective view of a melt bond calendaring apparatus.

Referring to FIGS. 9 and 10, the nonwoven thermal bond roller arrangement 108 preferably comprises a patterned calendar roller 110 and a smooth anvil roller 112. One or both of the patterned calendar roller 110 and the smooth anvil roller 112 may be heated and the pressure between the two rollers may be adjusted by well known means to provide the desired temperature, if any, and pressure to concurrently displace central layer 30 at melt bond sites, and melt bond the two outer layers together at a plurality of bond sites.

Figure 11:
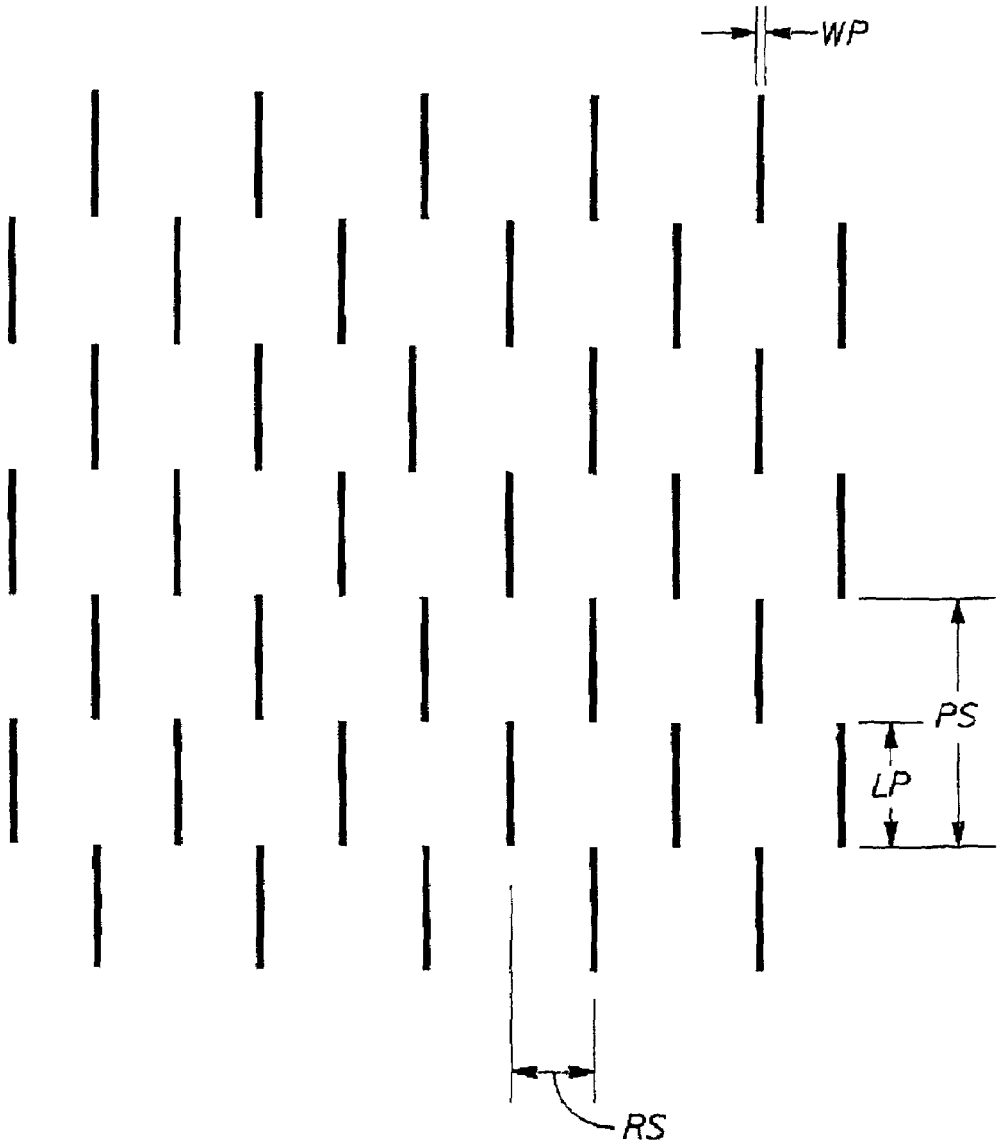
FIG. 11 is a schematic representation of a pattern for the protuberances of the calendaring roll.

The patterned calendar roller 110 is configured to have a circular cylindrical surface 114, and a plurality of protuberances or pattern elements 116 which extend outwardly from surface 114. The protuberances 116 are disposed in a predetermined pattern with each protuberance 116 being configured and disposed to displace central layer 30 at melt bond sites, and melt bond the two outer layers together at a plurality of locations. One pattern of protuberances is shown in FIG. 11. As shown, the protuberances 116 have a relatively small width, WP, which can be between about 0.003 inches and 0.020 inches, but in a preferred embodiment is about 0.010 inches. Protuberances can have a length, LP, of between about 0.030 inches and about 0.200 inches, and in a preferred embodiment has a length of about 0.100 inches. In a preferred embodiment, the protuberances have an aspect ratio of 10. The pattern shown is a regular repeating pattern of staggered protuberances, generally in rows, each separated by a row spacing, RS, of about between about 0.010 inches and about 0.200 inches. In a preferred embodiment, row spacing RS is about 0.060 inches. The protuberances can be spaced apart within a row by a protuberance spacing, PS generally equal to the protuberance length, LP. But the spacing and pattern can be varied in any way depending on the end product desired.

As shown in FIG. 10, patterned calendar roller 110 can have a repeating pattern of protuberances 116 which extend about the entire circumference of surface 114. Alternatively, the protuberances 116 may extend around a portion, or portions of the circumference of surface 114. Likewise, the protuberances 116 may be in a non-repeating pattern, or in a repeating pattern of randomly oriented protuberances.

The protuberances 116 are preferably truncated conical shapes which extend radially outward from surface 114 and which have rectangular or somewhat elliptical distal end surfaces 117. Although it is not intended to thereby limit the scope of the present invention to protuberances of only this configuration, it is currently believed that the high aspect ratio of the melt bond site 50 is only achievable if the protuberances likewise have a narrow width and a high aspect ratio at the distal end surfaces 117, as shown above with reference to FIG. 11. Without being bound by theory, it is believed that other suitable shapes for distal ends 117 may include, but are not limited to circular, square, rectangular, etc., if they facilitate the bonding and aperturing of the laminate web. The roller 110 is preferably finished so that all of the end surfaces 117 lie in an imaginary right circular cylinder which is coaxial with respect to the axis of rotation of roller 110.

The height of the protuberances should be selected according to the thickness of the laminate being bonded. In general, the height dimension should be greater than the maximum thickness of the laminate web during the calendaring process, so that adequate bonding occurs at the bond sites, and only at the bond sites.

Anvil roller 112, is preferably a smooth surfaced, right circular cylinder of steel.

After passing through nip 106, the three (or more) component webs 120, 130, and 140 have been formed into laminate web 10. At this point in the process the outer layers are thermally bonded and unapertured, as shown in FIGS. 1 and 2. Central layer(s) 30, from web 130, is apertured, having been displaced by protuberances 116 in nip 106.

The laminate web 10 may be further processed to form apertures in the whole laminate web extending portions of the web in a direction orthogonal to the axis 1 of bond sites 50. It is by this process that the open area of the web is formed. As shown in FIGS. 9 and 10, the axis 1 is generally parallel to the machine direction MD of the web being processed. Therefore, extension in the cross-direction CD at the bonded portions causes the bond sites 50 to rupture and open to form apertures in the web.

One method for forming apertures across the web is to pass the web through nip 130 formed by an incremental stretching system 132 employing opposed pressure applicators 134 and 136 having three-dimensional surfaces which at least to a degree are complementary to one another. Stretching of the laminate web may be accomplished by other methods known in the art, including tentoring, or even by hand. However, to achieve even strain levels across the web, and especially if localized strain differentials are desired, the incremental stretching system disclosed herein is preferred.

Figure 12:
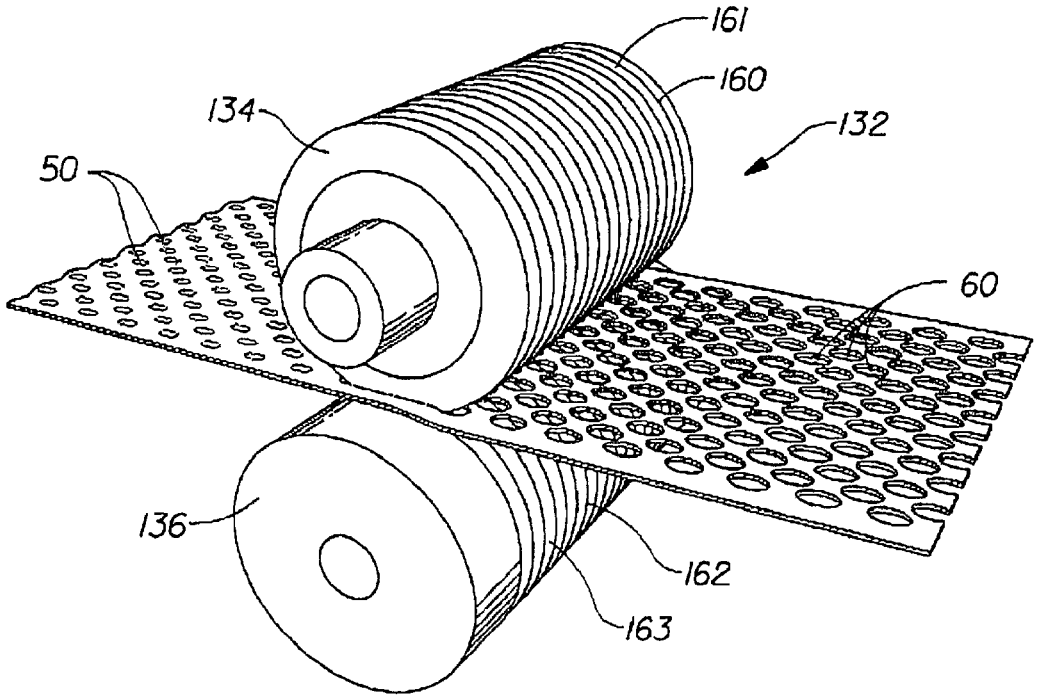
FIG. 12 is a perspective view of an apparatus for stretching a laminate of the present invention to form apertures therein.
Figure 13:
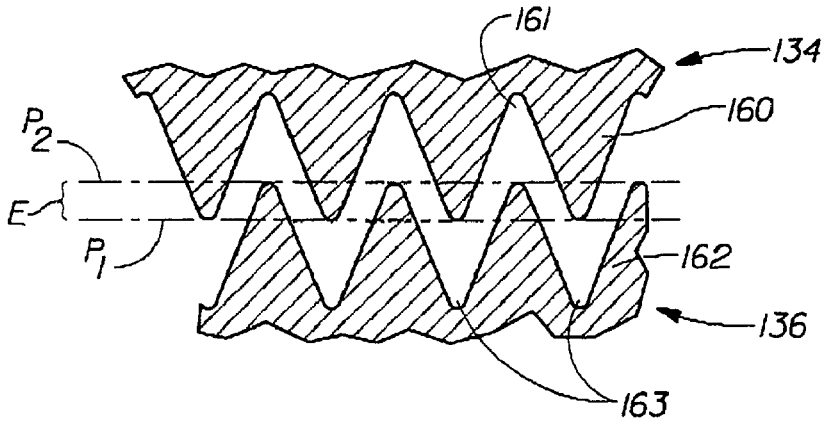
FIG. 13 is a cross-sectional view of a portion of the mating portions of the apparatus shown in FIG. 12.

Referring now to FIG. 12, there is shown a fragmentary enlarged view of the incremental stretching system 132 comprising incremental stretching rollers 134 and 136. The incremental stretching roller 134 includes a plurality of teeth 160 and corresponding grooves 161 which extend about the entire circumference of roller 134. Incremental stretching roller 136 includes a plurality of teeth 162 and a plurality of corresponding grooves 163. The teeth 160 on roller 134 intermesh with or engage the grooves 163 on roller 136, while the teeth 162 on roller 136 intermesh with or engage the grooves 161 on roller 134. The teeth of each roller are generally triangular-shaped, as shown in FIG. 13. The apex of the teeth may be slightly rounded, if desired for certain effects in the finished web.

With reference to FIG. 13, which shows a portion of the intermeshing of the teeth 160 and 162 of rollers 134 and 136, respectively. The term "pitch" as used herein, refers to the distance between the apexes of adjacent teeth. The pitch can be between about 0.02 to about 0.30 inches, and is preferably between about 0.05 and about 0.15 inches. The height (or depth) of the teeth is measured from the base of the tooth to the apex of the tooth, and is preferably equal for all teeth. The height of the teeth can be between about 0.10 inches and 0.90 inches, and is preferably about 0.25 inches and 0.50 inches.

The teeth 160 in one roll can be offset by one-half the pitch from the teeth 162 in the other roll, such that the teeth of one roll (e.g., teeth 160) mesh in the valley (e.g., valley 163) between teeth in the mating roll. The offset permits intermeshing of the two rollers when the rollers are "engaged" or in an intermeshing, operative position relative to one another. In a preferred embodiment, the teeth of the respective rollers are only partially intermeshing. The degree to which the teeth on the opposing rolls intermesh is referred to herein as the "depth of engagement" or "DOE" of the teeth. As shown in FIG. 13, the DOE, E, is the distance between a position designated by plane P1 where the apexes of the teeth on the respective rolls are in the same plane (0% engagement) to a position designated by plane P2 where the apexes of the teeth of one roll extend inward beyond the plane P1 toward the valley on the opposing roll. The optimum or effective DOE for particular laminate webs is dependent upon the height and the pitch of the teeth and the materials of the web.

In other embodiments the teeth of the mating rolls need not be aligned with the valleys of the opposing rolls. That is, the teeth may be out of phase with the valleys to some degree, ranging from slightly offset to greatly offset.

As the laminate web 10 having melt bonded locations 50 passes through the incremental stretching system 132 the laminate web 10 can be subjected to tensioning in the CD or cross-machine direction causing the laminate web 10 to be extended in the CD direction. Alternatively, or additionally the laminate web 10 may be tensioned in the MD (machine direction). The tensioning force placed on the laminate web 10 can be adjusted (e.g., by adjusting DOE) such that it causes the melt bonded locations 50 to separate or rupture creating a plurality of apertures 60 coincident with the melt bonded locations 50 in the laminate web 10. However, portions of the melt bonds of the laminate web 10 remain, as indicated by portions 62 in FIG. 4, thereby maintaining the nonwoven web in a coherent condition even after the melt bonded locations rupture.

After being subjected to the tensioning force applied by the incremental stretching system 132, the laminate web 10 includes a plurality of apertures 60 which are coincident with the melt bonded regions 50 of the laminate web. As mentioned, a portion of the circumferential edges of apertures 60 include remnants 62 of the melt bonded locations 60. It is believed that the remnants 60 help to resist further tearing or delamination of the laminate web.

Figure 14:
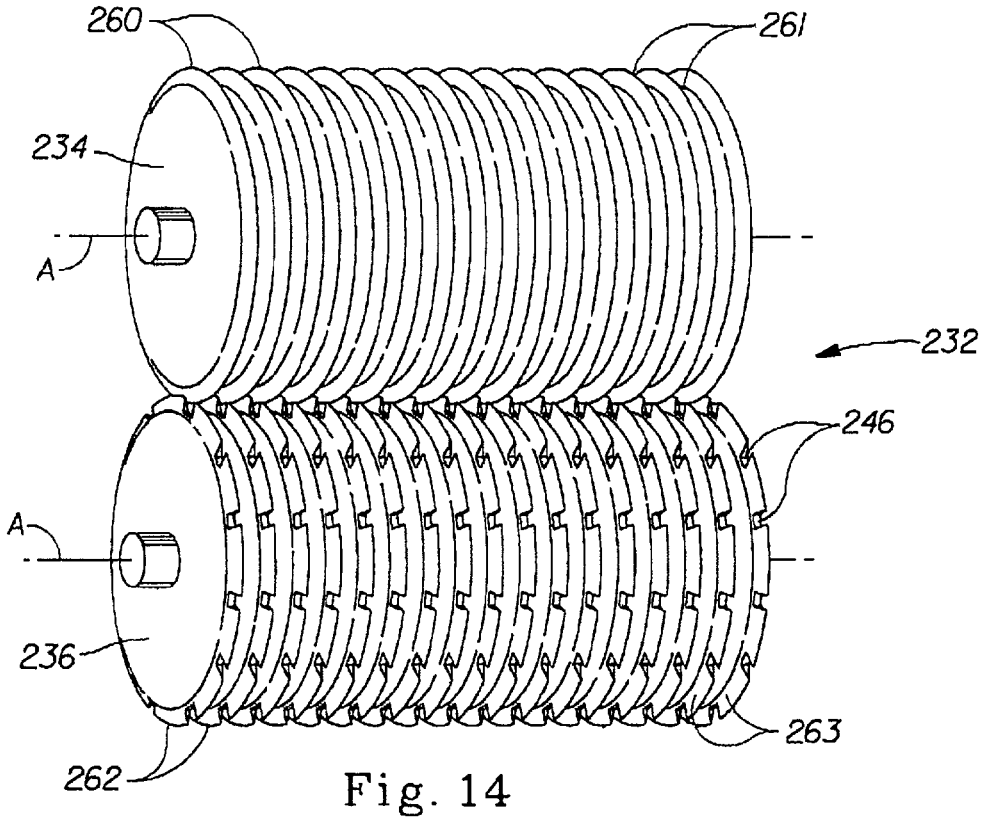
FIG. 14 is a perspective view of an alternative apparatus for stretching a laminate of the present invention in the cross-machine direction to form apertures therein.

Instead of two substantially identical rolls 134 and 136, one or both rolls can be modified to produce extension and additional patterning. For example, one or both rolls can be modified to have cut into the teeth several evenly-spaced thin planar channels 246 on the surface of the roll, as shown on roll 236 in FIG. 14. In FIG. 14 there is shown an enlarged view of an alternative incremental stretching system 232 comprising incremental stretching rollers 234 and 236. The incremental stretching roller 234 includes a plurality of teeth 260 and corresponding grooves 261 which extend about the entire circumference of roller 234. Incremental stretching roller 236 includes a plurality of teeth 262 and a plurality of corresponding grooves 263. The teeth 260 on roller 234 intermesh with or engage the grooves 263 on roller 236, while the teeth 262 on roller 236 intermesh with or engage the grooves 261 on roller 234. The teeth on one or both rollers can have channels 246 formed, such as by machining, such that regions of undeformed laminate web material may remain after stretching. A suitable pattern roll is described in U.S. Pat. No. 5,518,801, issued May 21, 1996, in the name of Chappell, et al., the disclosure of which is incorporated herein by reference.

Figure 15:
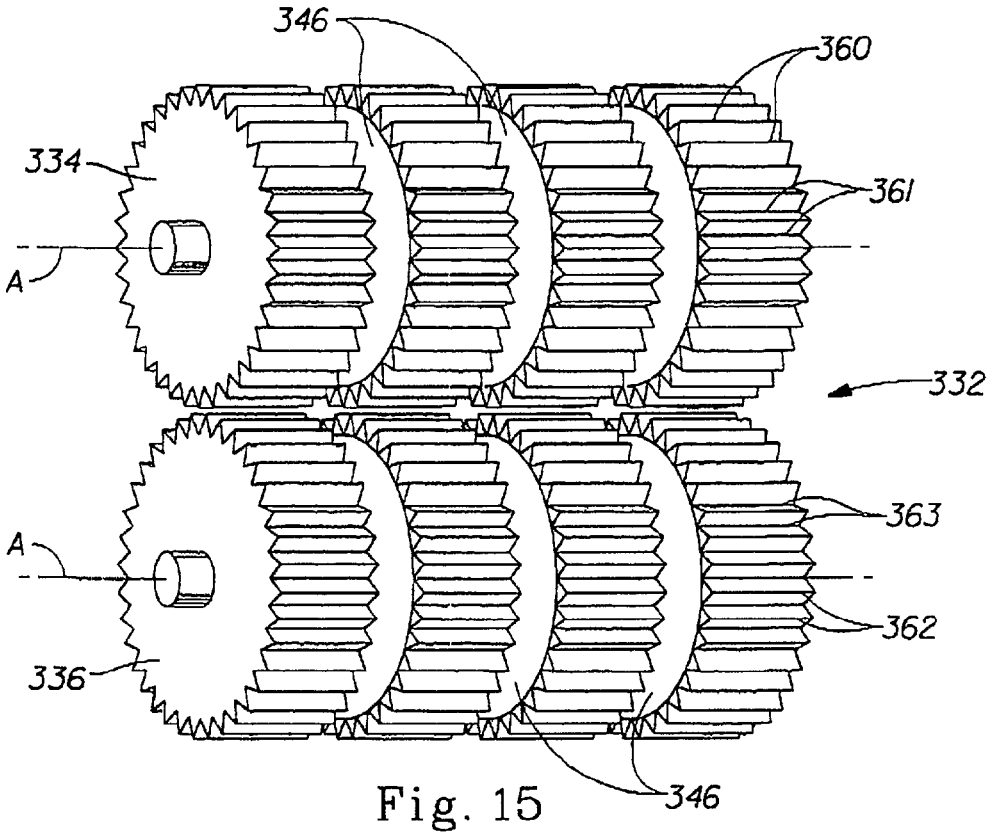
FIG. 15 is a perspective view of another alternative apparatus for stretching a laminate of the present invention in the machine direction to form apertures therein.

Likewise, the incremental stretching can be by mating rolls oriented as shown in FIG. 15. Such rolls comprise a series of ridges 360, 362, and valleys, 361, 363 that run parallel to the axis, A, of the roll, either 334 or 336, respectively. The ridges form a plurality of triangular-shaped teeth on the surface of the roll. Either or both rolls may also have a series of spaced-apart channels 346 that are oriented around the circumference of the cylindrical roll. Rolls as shown are effective in incrementally stretching a laminate having bond sites 50 having the axis 1 oriented generally parallel to the cross-machine (CD) direction of the web as its being processed.

Figure 16:
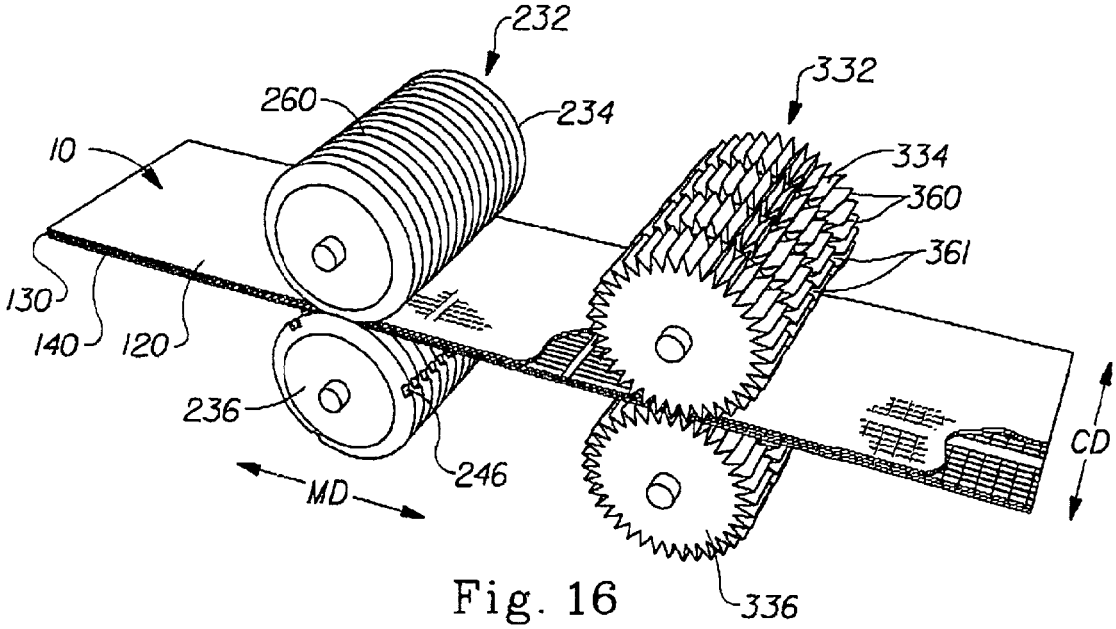
FIG. 16 is a perspective representation of an apparatus for stretching a laminate of the present invention in both the cross-machine and machine directions to form apertures therein.
Figure 17:
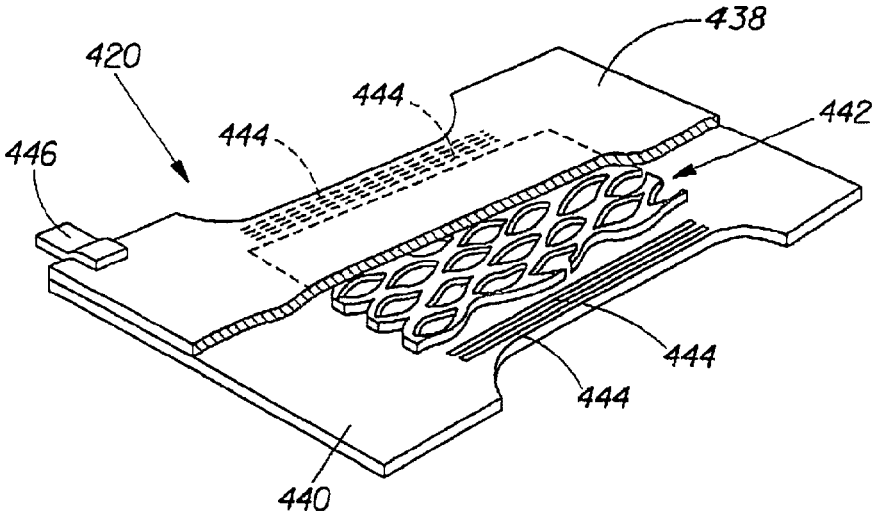
FIG. 17 is a perspective view of a disposable absorbent article having components that can be made of laminate web material of the present invention.

In one embodiment, the method of the making the laminate web of the articles of the present invention can comprise both CD and MD incremental stretching. As shown in FIG. 16, two pairs of incremental stretching rolls can be used in line, such that one pair (232, which, as shown in FIG. 16 includes a series of spaced-apart channels 246) performs CD stretching, and another pair, 332 performs MD stretching. By this method many interesting fabric-like textures can be made to be incorporated into the articles of the present invention. The resulting hand and visual appearance make such fabric-like webs ideal for use in the articles of the present invention.

c. Solid State Post Formation Technology

Another embodiment of the cleaning sheets of the present invention comprises a material which is a multiply substrate having one or more hydrophobic outer plies, preferably polyethylene and/or nylon, preferably nylon-6, and one or more hydrophilic inner plies, preferably cellulosic, more preferably absorbent.

Cleaning sheets in accordance with the present invention comprising such material has been found to surprisingly resist folding, especially refolding upon itself even after an initial fold has been formed in the cleaning sheet. Further, such cleaning sheets tend to unfold from a folded state upon use.

Apertures in Cleaning Sheets

The cleaning sheets of the present invention may comprise apertures. The apertures are preferably formed and/or arranged in such a way as to reduce the tendency of the cleaning sheet to fold, especially refold upon itself even after an initial fold has been formed in the cleaning sheet.

Figure 18:
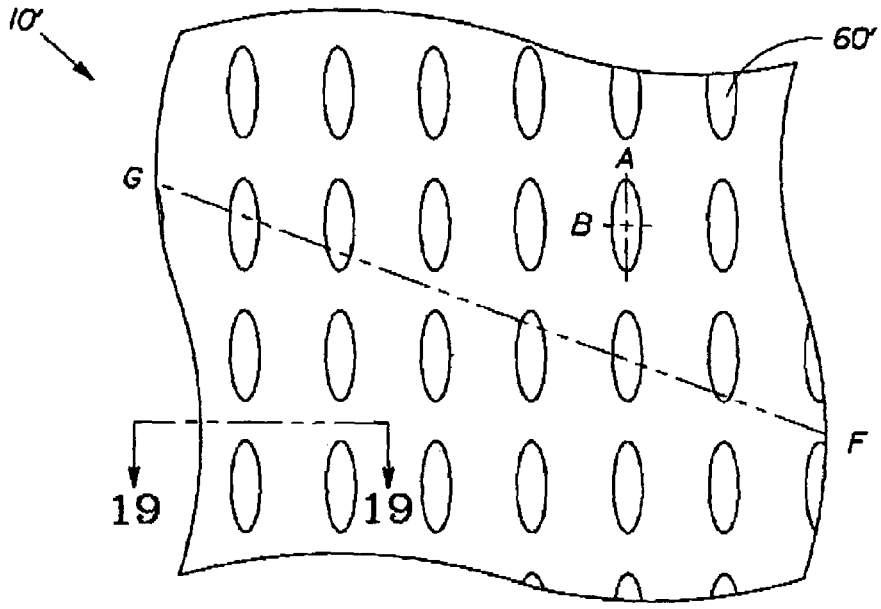
FIG. 18 is a schematic illustration of an embodiment of a cleaning sheet in accordance with the present invention.

As shown in FIG. 18, a cleaning sheet 10' in accordance with the present invention comprises apertures 60' preferably formed and/or arranged in such a way as to reduce the tendency of the cleaning sheet 10' to fold. Each aperture 60' preferably has a major axis A and a minor axis B, preferably the major axis A is at least 1.5 times the length of the minor axis B. A fold line F-G when formed in such a cleaning sheet 10' as shown in FIG. 18 is preferably formed substantially parallel to the minor axis B of the apertures. Substantially parallel to the minor axis of the aperture means that the fold line is positioned at an angle less than 90°, preferably less than 70°, more preferably less than 45° to the minor axis.

The apertures may be made by any suitable process known in the art. A nonlimiting example of a suitable process is described hereinabove.

Encasement

Figure 19:
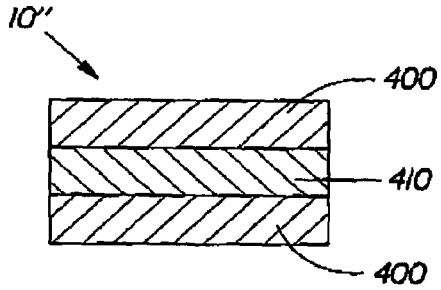
FIG. 19 is a schematic cross-sectional view of an embodiment of a cleaning sheet in accordance with the present invention.

In addition to materials and apertures useful in the cleaning sheets of the present invention, as shown in FIG. 19 a cleaning sheet 10" in accordance with the present invention may include an outer sheet 400 (coversheet) and an inner sheet 410 wherein the outer sheet 400 wholly or partially, preferably wholly, encases the inner sheet 410.

The outer sheet 400 preferably is hydrophobic and the inner sheet 410 is preferably hydrophilic.

The outer sheet 400 can be made hydrophobic by any process known in the art, such as by printing the sheet with a hydrophobic ink, applying a paint and/or other materials to render the sheet hydrophobic.

Figure 20:
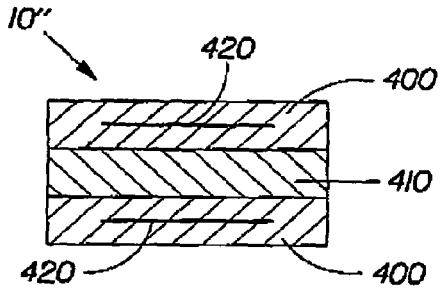
FIG. 20 is a schematic cross-sectional view of an embodiment of a cleaning sheet in accordance with the present invention.

In a preferred embodiment as shown in FIG. 20, the outer sheet 400 comprises crepe 420, preferably a discrete layer of crepe.

Preferably, cleaning sheets comprising outer sheets that wholly or partially encase inner sheets are arranged such that the outer sheets and inner sheets can contract and/or expand independent of one another. More preferably, the outer sheets and inner sheets are arranged such that when an initial fold line is formed in the cleaning sheet the fold line in the outer and inner sheets are aligned, and then upon use of the cleaning sheet the fold line in the outer and inner sheets become non-aligned such that the cleaning sheet resists folding.

Cleaning/Refreshment Composition

The cleaning sheets of the present invention preferably comprise a cleaning/refreshment composition releasably absorbed in the cleaning sheet. By "releasably contains" means that the composition is effectively released from the cleaning sheet onto an article, preferably soiled fabrics as part of a non-immersion cleaning and fabric refreshment process as described herein. This release occurs mainly by volatilization of the composition from the cleaning sheet.

The cleaning/refreshment composition preferably comprises water and a member selected from the group consisting of surfactants, perfumes, preservatives, bleaches, auxiliary cleaning agents, organic solvents and mixtures thereof. The preferred organic solvents are glycol ethers, specifically, methoxy propoxy propanol, ethoxy propoxy propanol, propoxy propoxy propanol, butoxy propoxy propanol, butoxy propanol and mixtures thereof. The surfactant is preferably a nonionic surfactant, such as an ethoxylated alcohol or ethoxylated alkyl phenol, and is present at up to about 2%, by weight of the cleaning/refreshment composition. Typical fabric cleaning refreshment/compositions herein can comprise at least about 80%, by weight, water, preferably at least about 90%, and more preferably at least about 95% water.

The Examples below give specific ranges for the individual components of preferred cleaning/refreshment compositions for use herein. A more detailed description of the individual components of the cleaning/refreshment compositions, that is, the organic solvents, surfactants, perfumes, preservatives, bleaches and auxiliary cleaning agents can be found in U.S. Pat. No. 5,789,368, which issued on Aug. 4, 1998 to You et al. and in U.S. Pat. No. 5,591,236, which issued on Jan. 7, 1997 to Roetker. The entire disclosure of the You et al. and the Roetker patents are incorporated herein by reference. Additionally, cleaning/refreshment compositions are described in co-pending U.S. Pat. No. 5,912,408, which was filed on Jan. 24, 1997, in the name of Trinh et al. The entire disclosure of the Trinh et al. Application is incorporated herein by reference.

It is especially preferred that the cleaning/refreshment compositions of this invention include a shrinkage reducing composition, which is preferably selected from the group consisting of ethylene glycol, all isomers of propanediol, butanediol, pentanediol, hexanediol and mixtures thereof, and more preferably selected from the group consisting of neopentyl glycol, polyethylene glycol, 1,2-propanediol, 1,3-butanediol, 1-octanol and mixtures thereof. The shrinkage reducing composition is preferably neopentyl glycol or 1,2-propanediol, and is more preferably 1,2-propanediol. The ratio of shrinkage reducing composition to cleaning/refreshment composition is preferably from about 1:2 to about 1:5, preferably from about 1:2 to about 1:4, more preferably from about 1:3 to about 1:4, and most preferably about 1:3.6.

In addition to the above ingredients, the cleaning/refreshment composition may optionally comprise a bleaching agent, preferably hydrogen peroxide.

Kits

The cleaning sheets of the present invention may be incorporated into kits. Such kits comprise a plurality of cleaning sheets.

In another embodiment, a kit in accordance with the present invention comprises one or more cleaning sheets and a containment bag, preferably a reusable containment bag, more preferably a fabric reusuable containment bag. Nonlimiting examples of such containment bags are described in U.S. Pat. Nos. 5,789,368 and 5,681,355 and U.S. patent application Ser. No. 60/190,640.

In another embodiment, a kit in accordance with the present invention comprises one or more cleaning sheets and a stain remover system. Nonlimiting examples of stain remover systems are described in U.S. Pat. Nos. 5,891,197, 5,872,090, 5,849,039, 5,789,368 and 5,681,355 and U.S. Patent Application Ser. No. 60/190,640.

Consumer Signals

The cleaning sheets of the present invention may comprise a consumer signal component to communicate to the consumer the state of the cleaning sheet. For example, the consumer signal may communicate to the consumer that the cleaning sheet has been used and/or partially used or in other words that the cleaning composition of the cleaning sheet has been consumed and/or partially consumed. In another example, the consumer signal may communicate that the cleaning sheet has not been used or in other words that the cleaning composition of the cleaning sheet has not been consumed.

The consumer signal component comprises a material that is capable of being sensed by a consumer's sensory system, such as sight, touch, smell and/or hearing.

Such consumer signal components may be noticeable prior to use and unnoticeable upon use (consumption) and/or the consumer signal components may be unnoticeable prior to use and noticeable upon use (consumption).

Nonlimiting examples of such consumer signal components include the following, visual marks such as trademarks, logos, and the like that are incorporated into the cleaning sheet, colors such that the cleaning sheet changes colors upon use (consumption), colors such that lint, dirt and/or other particulates are visible upon the cleaning sheet after use (consumption), perfume such that a perfume scent is either noticeable prior to use (consumption) or noticeable after use (consumption), additional materials incorporated into and/or on the cleaning sheet such that the additional materials separate from the cleaning sheet upon use (consumption). Nonlimiting examples of such additional materials include particulates, crystals, nonwoven materials and/or woven materials.

The following Examples further illustrate the invention, but are not intended to be limiting thereof.

EXAMPLE I

Cleaning and Refreshing Compositions

Fabric cleaning/refreshment compositions according to the present invention, for use in a containment bag, are prepared as follows:

| Ingredient | % (wt.) |
|---|---|
| Emulsifier (TWEEN 20)* | 0.5 |
| Perfume | 0.5 |
| KATHON ® | 0.0003 |
| Sodium Benzoate | 0.1 |
| Water | Balance |

*Polyoxyethylene (20) sorbitan monolaurate available from ICI Surfactants.

Additionally, preferred compositions for use in the in-dryer cleaning/refreshment step of the process herein are as follows.

| Ingredient | % (wt.) | Range (% wt.) |
|---|---|---|
| Water | 99.0 | 95.1-99.9 |
| Perfume | 0.5 | 0.05-1.5 |
| Surfactant | 0.5 | 0.05-2.0 |
| Ethanol or Isopropanol | 0 | Optional to 4% |
| Solvent (e.g. BPP) | 0 | Optional to 4% |
| pH range from about 6 to about 8. | | |

Additionally, preferred compositions for use in the in-dryer cleaning/refreshment step of the process herein are as follows:

| Ingredient | % (wt.) | % (wt.) | % (wt.) | % (wt.) |
|---|---|---|---|---|
| Water | 97.63 | 98.85 | 77.22 | 96.71 |
| Perfume | 0 | 0.38 | 0.38 | 0 |
| Surfactant | 0.285 | 0 | 0 | 0.285 |
| Solvent (e.g. BPP) | 2.0 | 0 | 0 | 2.0 |
| KATHON ® | 0.0003 | 0 | 0 | 0 |
| Emulsifier (TWEEN 20)* | 0 | 0.5 | 0.38 | 0 |
| Amine Oxide | 0.0350 | 0 | 0 | 0.0350 |
| $MgCl_2$ | 0.045 | 0 | 0 | 0 |
| $MgSO_4$ | 0 | 0 | 0.058 | 0 |
| Hydrogen Peroxide | 0 | 0 | 0 | 0.6 |
| Citric Acid | 0 | 0 | 0 | 0.05 |
| Proxel GXL | 0 | 0.08 | 0.08 | 0 |
| Bardac 2250 | 0 | 0.2 | 0.2 | 0 |
| 1,2-Propanediol | 0 | 0 | 21.75 | 0 |

*Polyoxyethylene (20) sorbitan monolaurate available from ICI Surfactants.

Besides the other ingredients, the foregoing compositions can contain enzymes to further enhance cleaning performance, as described in the Trinh et al. patent incorporated herein above.

What is claimed:

1. A cleaning sheet comprising:

a. at least three layers comprising:

i. a first outer layer;

ii. a second outer layer; and iii. a third central layer comprising a viscoelastic material in the form of a sheet, wherein said third central layer is disposed between said first outer layer and said second outer layer, and b. a liquid cleaning/refreshment composition releasably absorbed in said viscoelastic material;

wherein said cleaning sheet comprises a longitudinal direction and said at least three layers form a plurality of apertures comprising: a perimeter having a length dimension corresponding to said longitudinal direction and a width dimension orthogonal to said longitudinal direction;

wherein said at least three layers are thermally bonded at portions of said perimeter corresponding to said length dimension and not thermally bonded at portions of said perimeter corresponding to said width dimension; and wherein the central layer is fragmented, forming discontinuous regions.

2. The cleaning sheet according to claim 1, wherein said viscoelastic material comprises an open area of from about 10% to about 20% of the surface area of the viscoelastic material.

3. The cleaning sheet according to claim 1, wherein said first outer layer and said second outer layer are non-wovens.

4. The cleaning sheet according to claim 1, wherein said third central layer comprises a non-woven.

5. The cleaning sheet according to claim 1, wherein said third central layer is selected from the group consisting of a cellulosic material; a metallic material; a woven or knit material; a thermoset material.

6. The cleaning sheet according to claim 1, wherein said third central layer is selected from the group consisting of cellulosics, thermoplastic battings, metallic foils, metallic battings, sponges, formed films, and combinations thereof.

7. The cleaning sheet according to claim 1, wherein said first outer layer comprises an elongation to break, said second outer layer comprises an elongation to break and said third central layer comprises a elongation to break which is less than both the elongations to break of said first outer layer and said second outer layer.

8. The cleaning sheet according to claim 1, wherein said plurality of apertures is disposed in a regular, repeating pattern oriented generally in the longitudinal direction of said cleaning sheet.

9. The cleaning sheet according to claim 1, wherein the viscoelastic material comprises a polymer.

10. The cleaning sheet according to claim 1, wherein the viscoelastic material comprises a hydrophilic material and/or a hydrophobic material.

11. The cleaning sheet according to claim 10, wherein the hydrophilic material comprises a cellulosic material.

12. The cleaning sheet according to claim 1, wherein the viscoelastic material is prepared by solid state post formation technology.

13. The cleaning sheet according to claim 1, wherein the viscoelastic material is prepared by differential elongation composite technology.

14. The cleaning sheet according to claim 1, wherein the liquid cleaning/refreshment composition comprises water and a member selected from the group consisting of organic solvents, organic surfactants, auxiliary cleaning agents, perfumes and mixture thereof.

15. The cleaning sheet according to claim 1, wherein the liquid cleaning/refreshment composition comprises water and a surfactant.

16. The cleaning sheet according to claim 15, wherein the surfactant comprises a nonionic surfactant.

17. The cleaning sheet according to claim 16, wherein the nonionic surfactant is selected from the group consisting of ethoxylated alcohols, ethoxylated alkyl phenols and mixtures thereof.

18. The cleaning sheet according to claim 1, wherein said at least three layers is wholly or partially covered by a coversheet which is permeable to the liquid cleaning/refreshment composition.

19. The cleaning sheet according to claim 1 wherein the cleaning sheet is a dryer sheet.

20. The cleaning sheet according to claim 1, wherein the cleaning sheet further comprises a consumer signal component.

21. The cleaning sheet according to claim 1, wherein said at least three layers is wholly or partially covered by a cleaning sheet.

22. The cleaning sheet according to claim 21, wherein the coversheet substantially encases said at least three layers.

23. The cleaning sheet according to claim 21, wherein said at least three layers is bonded to the coversheet at discrete areas, whereby, in-use, said at least three layers is maintained in its original configuration relative to the coversheet.

24. The cleaning sheet according to claim 21, wherein the coversheet comprises a hydrophobic material.

25. The cleaning sheet according to claim 24, wherein the coversheet comprises a hydrophobic ink.

26. The cleaning sheet according to claim 24, wherein the coversheet comprises paint.

27. The cleaning sheet according to claim 21, wherein the coversheet comprises a cellulosic material.

28. The cleaning sheet according to claim 21, wherein the coversheet comprises apertures.

29. The cleaning sheet according to claim 21, wherein the coversheet comprises crepe.

30. The cleaning sheet according to claim 24, wherein the hydrophobic material comprises crepe.

31. The cleaning sheet according to claim 21, wherein the coversheet comprises polyethylene.

32. The cleaning sheet according to claim 21, wherein the coversheet comprises nylon.

33. An overall non-immerion cleaning/refreshment process for treating a fabric, which optionally comprises a prespotting operation, comprising the overall steps of:

a) placing the fabric together with the cleaning sheet according to claim 1 in a tumbling apparatus; and b) operating the tumbling apparatus.

34. The process according to claim 33 wherein the tumbling apparatus is a hot air clothes dryer.

35. The process according to claim 33 wherein the process further comprises placing the fabric together with the cleaning sheet according to claim 1 into a containment bag prior to placing into the tumbling apparatus.

36. The process according to claim 35 wherein vapors are vented from the containment bag during step b).

37. A kit comprising a plurality of cleaning sheets according to claim 1.

38. A kit comprising:

a) one or more cleaning sheets according to claim 1; and b) a re-usable containment bag.

39. A kit comprising:

a) one or more cleaning sheets according to claim 1; and b) a stain remover system.

* * * * *